US011383517B2

(12) United States Patent
Yazaki

(10) Patent No.: US 11,383,517 B2
(45) Date of Patent: Jul. 12, 2022

(54) LIQUID EJECTING HEAD, LIQUID EJECTING APPARATUS, AND PIEZOELECTRIC DEVICE

(71) Applicant: SEIKO EPSON CORPORATION, Tokyo (JP)

(72) Inventor: Shiro Yazaki, Chino (JP)

(73) Assignee: Seiko Epson Corporation, Tokyo (JP)

( * ) Notice: Subject to any disclaimer, the term of this patent is extended or adjusted under 35 U.S.C. 154(b) by 103 days.

(21) Appl. No.: 17/067,095

(22) Filed: Oct. 9, 2020

(65) Prior Publication Data

US 2021/0023845 A1 Jan. 28, 2021

Related U.S. Application Data

(63) Continuation of application No. 15/804,819, filed on Nov. 6, 2017, now Pat. No. 10,814,625.

(30) Foreign Application Priority Data

Dec. 2, 2016 (JP) ..... 2016-235396

(51) Int. Cl.
*B41J 2/14* (2006.01)
*B41J 2/045* (2006.01)
(Continued)

(52) U.S. Cl.
CPC ..... *B41J 2/14233* (2013.01); *B41J 2/04568* (2013.01); *B41J 2/055* (2013.01);
(Continued)

(58) Field of Classification Search
None
See application file for complete search history.

(56) References Cited

U.S. PATENT DOCUMENTS

2002/0051040 A1 5/2002 Shimada
2006/0087536 A1 4/2006 Sugahara
(Continued)

FOREIGN PATENT DOCUMENTS

EP 0656665 6/1995
EP 1336489 8/2003
(Continued)

OTHER PUBLICATIONS

European Search Report for EP 17204675 dated Apr. 12, 2018.

*Primary Examiner* — Justin Seo
(74) *Attorney, Agent, or Firm* — Workman Nydegger

(57) ABSTRACT

A liquid ejecting head includes a flow path forming substrate in which a pressure generating chamber which communicates with a nozzle which ejects a liquid is formed by a partitioning wall, and a piezoelectric actuator in which a first electrode, a piezoelectric layer, and a second electrode are laminated, in which the piezoelectric layer includes a region which is interposed between the first electrode and the second electrode in a lamination direction, and in which when viewed in plan view from the lamination direction, the region overlaps at least a portion of the edges of each side of an opening of the pressure generating chamber on the piezoelectric actuator side and does not overlap one of the first electrode and the second electrode in at least a portion of the opening.

7 Claims, 12 Drawing Sheets

(51) Int. Cl.
*B41J 2/055* (2006.01)
*B41J 2/19* (2006.01)

(52) U.S. Cl.
CPC ..... *B41J 2/04581* (2013.01); *B41J 2/04588* (2013.01); *B41J 2/14072* (2013.01); *B41J 2/19* (2013.01); *B41J 2002/14306* (2013.01); *B41J 2002/14419* (2013.01); *B41J 2202/11* (2013.01)

(56) References Cited

U.S. PATENT DOCUMENTS

| | | | | |
|---|---|---|---|---|
| 2008/0030553 | A1 | 2/2008 | Takahashi | |
| 2009/0284568 | A1 | 11/2009 | Yazaki | |
| 2010/0208004 | A1 | 8/2010 | Ottosson | |
| 2011/0007114 | A1* | 1/2011 | Nakayama | B41J 2/14233 29/25.35 |
| 2011/0063348 | A1 | 3/2011 | Mita | |
| 2011/0316938 | A1 | 12/2011 | Yazaki | |
| 2014/0071206 | A1 | 3/2014 | Yazaki | |
| 2014/0267478 | A1 | 9/2014 | Yokoyama | |
| 2016/0093794 | A1 | 3/2016 | Kakamu | |

FOREIGN PATENT DOCUMENTS

| | | |
|---|---|---|
| JP | H11-129468 | 5/1999 |
| JP | 2011-018723 | 1/2011 |
| JP | 5278654 | 5/2013 |

* cited by examiner

LIQUID EJECTING HEAD, LIQUID EJECTING APPARATUS, AND PIEZOELECTRIC DEVICE

The present application is a continuation of U.S. patent application Ser. No. 15/804,819, filed Nov. 6, 2017, which claims priority to Japanese Patent Application No. 2016-235396, filed Dec. 2, 2016, the entire disclosures of which are expressly incorporated by reference herein.

BACKGROUND

1. Technical Field

The present invention relates to a liquid ejecting head which ejects a liquid from a nozzle, a liquid ejecting apparatus, and a piezoelectric device. In particular, the invention relates to an ink jet recording head which discharges an ink as the liquid, an ink jet recording apparatus, and a piezoelectric device.

2. Related Art

An ink jet recording head which discharges ink droplets is a representative example of the liquid ejecting head which discharges droplets. As this ink jet recording head, for example, there is known an ink jet recording head which includes a flow path forming substrate having a pressure generating chamber communicating with a nozzle opening and a piezoelectric actuator which is provided on one surface side of the flow path forming substrate, in which an ink droplet is ejected from a nozzle opening by using the piezoelectric actuator to generate a pressure change in the ink in a pressure generating chamber (for example, refer to Japanese Patent No. 5278654).

However, in order to obtain a high displacement amount in the piezoelectric actuator and in order to eject large ink droplets for the ink jet recording head, it is necessary to form the piezoelectric actuator long, that is, to form the piezoelectric actuator with a high aspect ratio, and there is a problem in that a space for disposing the piezoelectric actuator becomes necessary and the size becomes large. In particular, in a piezoelectric actuator having a high aspect ratio when viewed in plan view, since it is not possible to drive the end portion in the longitudinal direction, in order to improve the displacement amount of the piezoelectric actuator, it is necessary to make the piezoelectric actuator longer in the longitudinal direction and the size becomes large.

This problem is present not only in a liquid ejecting head ink that is represented by an ink jet recording head but also in the same manner in other piezoelectric devices.

SUMMARY

An advantage of some aspects of the invention is to provide a liquid ejecting head, a liquid ejecting apparatus, and a piezoelectric device which are capable of improving a displacement efficiency of a piezoelectric actuator with respect to the length thereof to obtain a reduction in size.

According to an aspect of the invention, a liquid ejecting head includes a flow path forming substrate in which a pressure generating chamber which communicates with a nozzle which ejects a liquid is formed by a partitioning wall, and a piezoelectric actuator in which a first electrode, a piezoelectric layer, and a second electrode are laminated, in which the piezoelectric layer includes a region which is interposed between the first electrode and the second electrode in a lamination direction, and in which when viewed in plan view from the lamination direction, the region overlaps at least a portion of the edges of each side of an opening of the pressure generating chamber on the piezoelectric actuator side and does not overlap one of the first electrode and the second electrode in at least a portion of the opening.

In this configuration, by providing the region which is interposed between the first electrode and the second electrode to overlap at least a portion of the edges of each side of the opening of the pressure generating chamber on the piezoelectric actuator side, it is possible to improve the displacement efficiency of the piezoelectric actuator with respect to the length of the pressure generating chamber. Therefore, even if the length of the pressure generating chamber is shortened and the length of the piezoelectric actuator is shortened, it is possible to suppress a reduction in the displacement characteristics, it is possible to reduce the size of the flow path forming substrate, and it is possible to dispose many pressure generating chambers and realize an increase in the number of nozzles.

Here, it is preferable that the opening be a parallelogram when viewed in plan view from the lamination direction. Accordingly, it is possible to easily dispose the nozzle communicating path, the supply path, and the like which communicate with the pressure generating chamber.

It is preferable that in at least a portion of the opening, a portion which does not overlap one of the first electrode and the second electrode have the same shape as the opening with a narrower area than the opening. Accordingly, it is possible to easily deform the piezoelectric actuator which faces the opening.

It is preferable that when viewed in plan view from the lamination direction, the region be provided to overlap an entirety of the edges of the opening. Accordingly, it is possible to easily perform the leading out of the individual electrode from the region.

It is preferable that a portion at which the first electrode and the second electrode do not overlap each other does not include the first electrode and the piezoelectric layer in at least a portion. Accordingly, it is possible to suppress the hindrance, caused by the piezoelectric layer, of the deformation of the portion which the first electrode and the second electrode do not overlap to easily deform the portion, and it is possible to easily deform the piezoelectric actuator.

It is preferable that a portion at which the first electrode and the second electrode do not overlap each other be provided at a center of the opening. Accordingly, it is possible to easily deform the piezoelectric actuator which faces the opening.

It is preferable that when viewed in plan view from the lamination direction, the nozzle be disposed on an outside of the region and on an inside of the pressure generating chamber. Accordingly, by setting the region which is interposed between the first electrode and the second electrode of the piezoelectric layer to a position which does not overlap the nozzle, the overlapping amount of the region over the partitioning wall is restricted, an excessive increase in the electrical capacitance of the piezoelectric actuator is suppressed, and it is possible to reduce the power consumption. When viewed in plan view from the lamination direction, by disposing the nozzle on the inside of the pressure generating chamber, it is possible to suppress an increase in the sizes of the flow path forming substrate and the nozzle plate.

It is preferable that the pressure generating chamber communicate with the nozzle on an opposite side from the piezoelectric actuator in the lamination direction, and that at least a portion of openings of the pressure generating chamber on the nozzle side does not overlap the region. Accordingly, the pressure generating chamber is provided to widen toward the opening on the nozzle side, it is possible to reduce the size of the opening of the pressure generating chamber on the piezoelectric actuator side and to obtain a reduction in size while securing the space to form the region which is interposed between the first electrode and the second electrode of the piezoelectric layer, and it is possible to increase the size of the opening of the pressure generating chamber on the nozzle side and to secure the necessary volume for the pressure generating chamber.

It is preferable that the opening of the pressure generating chamber on the opposite side from the piezoelectric actuator in the lamination direction be a parallelogram and a nozzle communicating path which communicates with the nozzle and a supply path which supplies a liquid to the pressure generating chamber be connected at each acute angle corner portion of the parallelogram. Accordingly, by connecting the nozzle communicating path and the supply path on the respective acute angle corner portions of the pressure generating chamber, it is possible to suppress the retention of the ink at the acute angle corner portions and to suppress the occurrence of ejection faults of the liquid caused by bubbles which are included in the liquid being retained at the acute angle corner portions.

It is preferable that multiple rows of the pressure generating chambers which are provided to line up in a first direction perpendicular to the lamination direction be formed in a second direction perpendicular to both the lamination direction and the first direction, and that the rows of pressure generating chambers which are provided in the second direction be disposed at different positions in the first direction. Accordingly, it becomes possible to dispose the nozzles at high density.

It is preferable that the pressure generating chamber include an inclined surface which is inclined in a direction widening to an opposite side from the piezoelectric actuator with respect to the lamination direction, and that when viewed in plan view from the lamination direction, an end portion of the region overlap the inclined surface. Accordingly, by providing an end portion of the region which is interposed between the first electrode and the second electrode of the piezoelectric layer on the inclined surface, it is possible to cause the boundary between the region which drives the piezoelectric actuator and the region which does not drive the piezoelectric actuator to be positioned on the inclined surface and to alleviate the stress of the boundary portion between the driving region and the non-driving region by the portion at which the inclined surface is formed deforming. Therefore, it is possible to suppress the occurrence of stress focusing at the boundary between the driving region and the non-driving region and to suppress destruction.

It is preferable that when viewed in plan view from the lamination direction, a width which overlaps the partitioning wall of the region in a normal line direction of the sides of the opening be greater than or equal to a thickness of the piezoelectric layer in the lamination direction and less than or equal to 10 μm. Accordingly, by setting the width of the region which is interposed between the first electrode and the second electrode of the piezoelectric layer to be greater than or equal to the thickness of the piezoelectric layer, it is possible to suppress the approaching of the boundary between the driving region on the partitioning wall and the non-driving region on the partitioning wall to an edge portion of the opening of the pressure generating chamber and to suppress destruction caused by stress at the boundary between the driving region on the partitioning wall and the non-driving region on the partitioning wall. By setting the width of the region which is interposed between the first electrode and the second electrode of the piezoelectric layer to less than or equal to 10 μm, it is possible to suppress an increase in the electrical capacitance of the piezoelectric actuator and an increase in the power consumption.

It is preferable that when viewed in plan view from the lamination direction, a width in which the region is provided to straddle an edge of the opening be in a range which is greater than or equal to 0.2 times and less than or equal to 0.5 times a width of the pressure generating chamber in a short direction. Accordingly, by defining the driving region which is interposed between the first electrode and the second electrode of the piezoelectric layer, it is possible to optimize the displacement efficiency of the piezoelectric actuator.

It is preferable that when viewed in plan view from the lamination direction, in at least a portion of the opening, a recessed portion which is open to an opposite side from the flow path forming substrate be provided in the piezoelectric layer of a portion which one of the first electrode and the second electrode does not overlap, and a width of the recessed portion in a short direction of the pressure generating chamber be in a range of greater than or equal to 0.1 times and less than or equal to 0.5 times a width of the pressure generating chamber. Accordingly, by defining the width of the recessed portion of the piezoelectric layer, it is possible to optimize the displacement efficiency of the piezoelectric actuator.

It is preferable that the piezoelectric actuator be formed on the flow path forming substrate via a diaphragm, and that a thickness of the diaphragm at a portion which one of the first electrode and the second electrode does not overlap in at least a portion of the opening in the lamination direction be thinner than the thickness of the diaphragm at the region. Accordingly, by reducing the thickness of the diaphragm at the portion which one of the first electrode and the second electrode does not overlap, the displacement of the portion becomes easy and it is possible to easily displace the piezoelectric actuator.

It is preferable that the piezoelectric layer be formed at a portion which one of the first electrode and the second electrode does not overlap in at least a portion of the opening. Accordingly, it is possible to suppress destruction which is caused by the displacement of the piezoelectric actuator.

According to another aspect of the invention, a liquid ejecting apparatus includes the liquid ejecting head of the above-described configuration.

In this configuration, it is possible to realize a liquid ejecting apparatus which is reduced in size.

Here, it is preferable to further include a control unit which supplies a drive signal, which includes an expanding element which charges the piezoelectric actuator to cause the pressure generating chamber to expand and a contracting element which discharges the piezoelectric actuator to cause the pressure generating chamber to contract, and causes a liquid to be ejected from the nozzle. Accordingly, since the internal stress of the piezoelectric layer is compressive stress in the expanding element, the destruction of the piezoelectric layer does not occur easily. Since the internal stress of the piezoelectric layer is only released in the contracting element, the destruction does not occur easily.

It is preferable that a potential difference of the expanding element be smaller than a potential difference of the contracting element. Accordingly, it is possible to further suppress the destruction of the piezoelectric layer.

According to still another aspect of the invention, a piezoelectric device includes a substrate in which a space is formed by a partitioning wall, and a piezoelectric actuator in which a first electrode, a piezoelectric layer, and a second electrode are laminated, in which the piezoelectric layer includes a region which is interposed between the first electrode and the second electrode in a lamination direction, and in which when viewed in plan view from the lamination direction, the region overlaps at least a portion of the edges of each side of an opening of the space on the piezoelectric actuator side and one of the first electrode and the second electrode does not overlap at least a portion of the opening.

In this configuration, by providing the region which is interposed between the first electrode and the second electrode to overlap at least a portion of the edges of each side of the opening of the space on the piezoelectric actuator side, it is possible to improve the displacement efficiency of the piezoelectric actuator with respect to the length of the space. Therefore, even if the length of the space is shortened and the length of the piezoelectric actuator is shortened, it is possible to suppress a reduction in the displacement characteristics, it is possible to reduce the size of the substrate, and it is possible to dispose many spaces.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a detailed description will be given of the invention based on the embodiments.

First Embodiment

Figure 1:
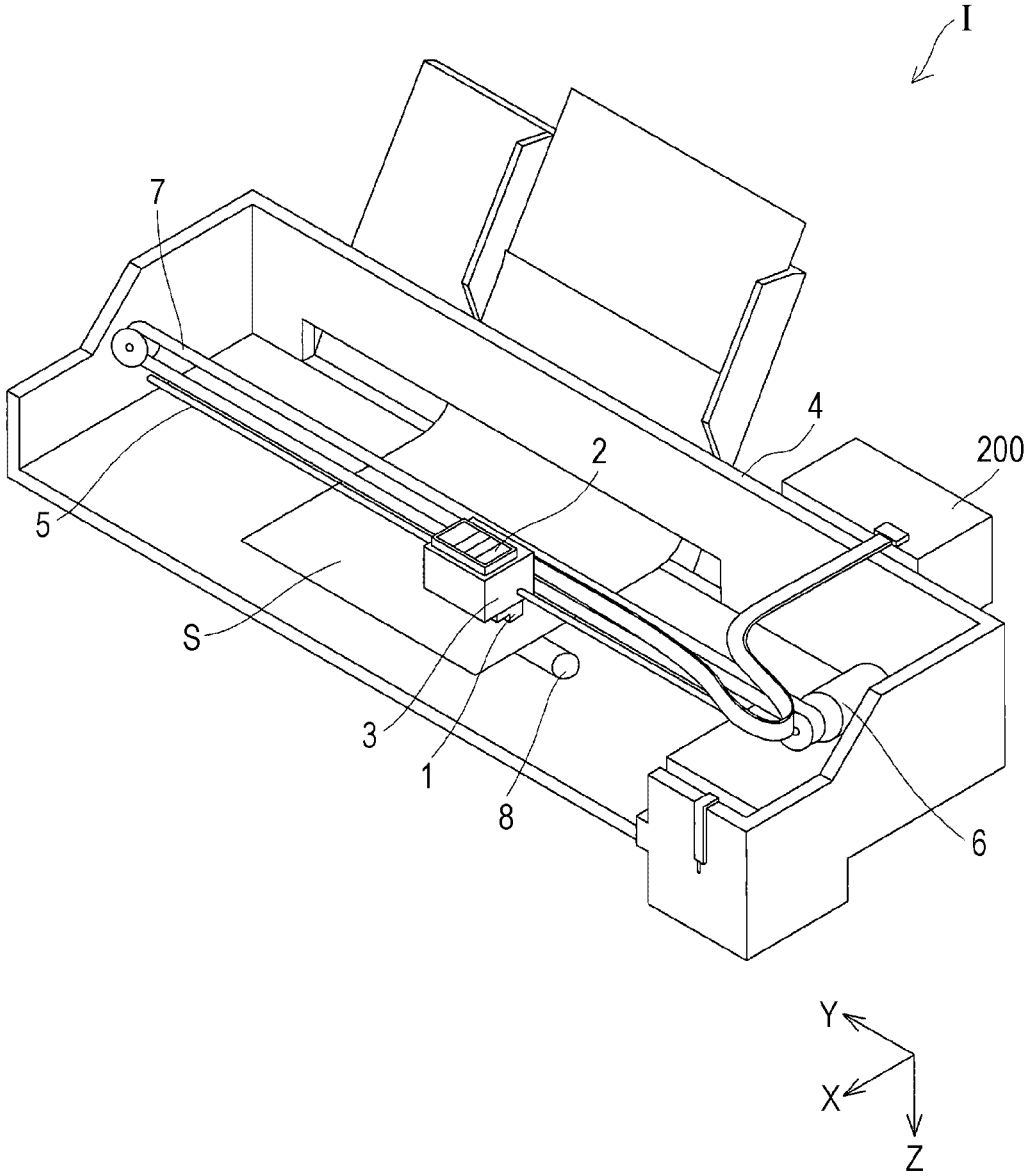
FIG. 1 is a diagram illustrating the schematic configuration of a recording apparatus according to a first embodiment of the invention.

FIG. 1 a diagram illustrating the schematic configuration of an ink jet recording apparatus which is an example of the liquid ejecting apparatus according to the first embodiment of the invention.

As illustrated, an ink jet recording apparatus I includes an ink jet recording head 1 (hereinafter also referred to as the recording head 1) which discharges an ink as a liquid. The recording head 1 is mounted on a carriage 3 and the carriage 3 is provided on a carriage shaft 5 which is attached to an apparatus main body 4 such that the carriage 3 is capable of moving in an axial direction of the carriage shaft 5. An ink cartridge 2 which configures a liquid supply unit is provided in the carriage 3 to be attachable and detachable.

The carriage 3 to which the recording head 1 is mounted moves along the carriage shaft 5 due to the driving force of a drive motor 6 being transmitted to the carriage 3 via a plurality of gears (not illustrated) and a timing belt 7. Meanwhile, the apparatus main body 4 is provided with a transport roller 8 as a transport unit and a recording sheet S, which is a medium such as paper on which the ink lands, is transported by the transport roller 8. The transport unit which transports the recording sheet S is not limited to being a transport roller and may be a belt, a drum, or the like. In the present embodiment, a transport direction of the recording sheet S is referred to as a first direction X. The movement direction of the carriage 3 along the carriage shaft 5 is referred to as a second direction Y. A direction intersecting both the first direction X and the second direction Y is referred to as a third direction Z in the present embodiment. In the present embodiment, the relationship between the directions (X, Y, and Z) is perpendicular; however, the dispositional relationship of the components is not necessarily limited to being perpendicular.

In the ink jet recording apparatus I, so-called printing is performed by causing the ink to land across substantially the entire surface of the recording sheet S by causing ink droplets to be discharged from nozzles of the recording head 1 while transporting the recording sheet S in the first direction X with respect to the recording head 1 and causing the carriage 3 to move in the second direction Y with respect to the recording sheet S.

Figure 2:
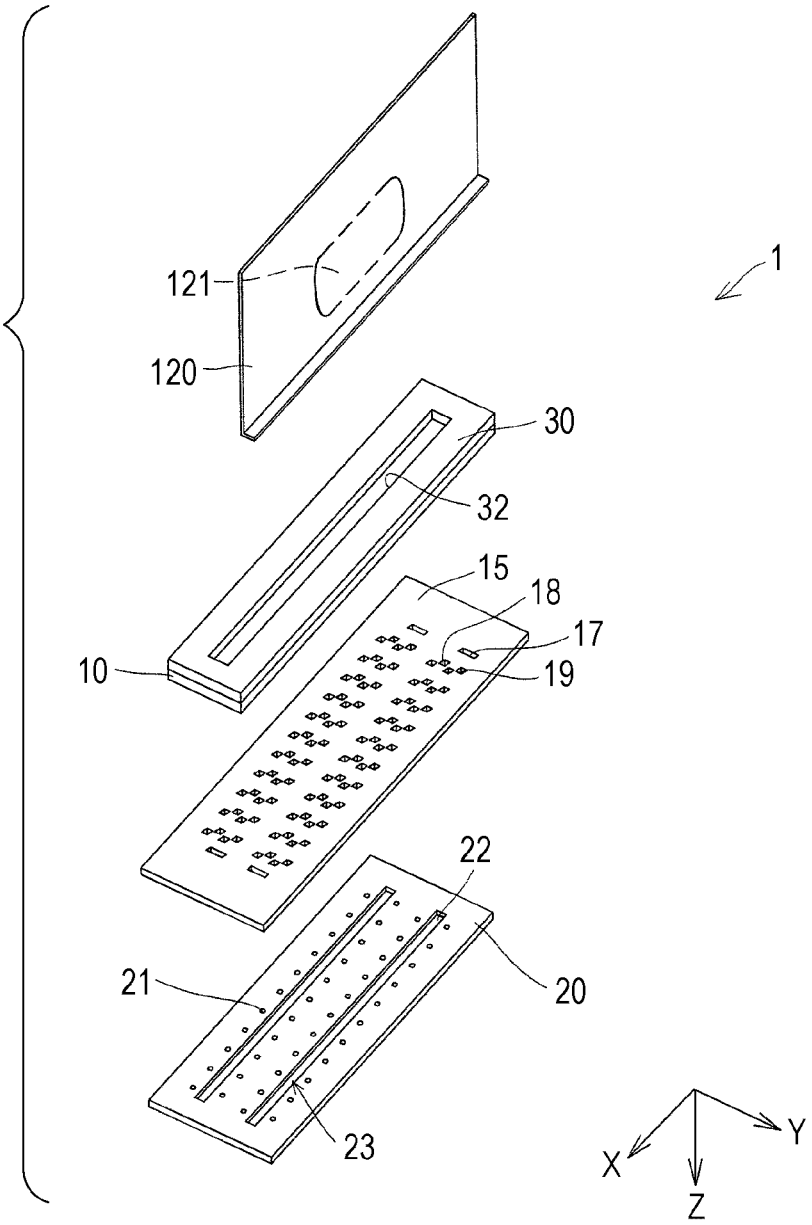
FIG. 2 is an exploded perspective diagram of a recording head according to the first embodiment of the invention.
Figure 3:
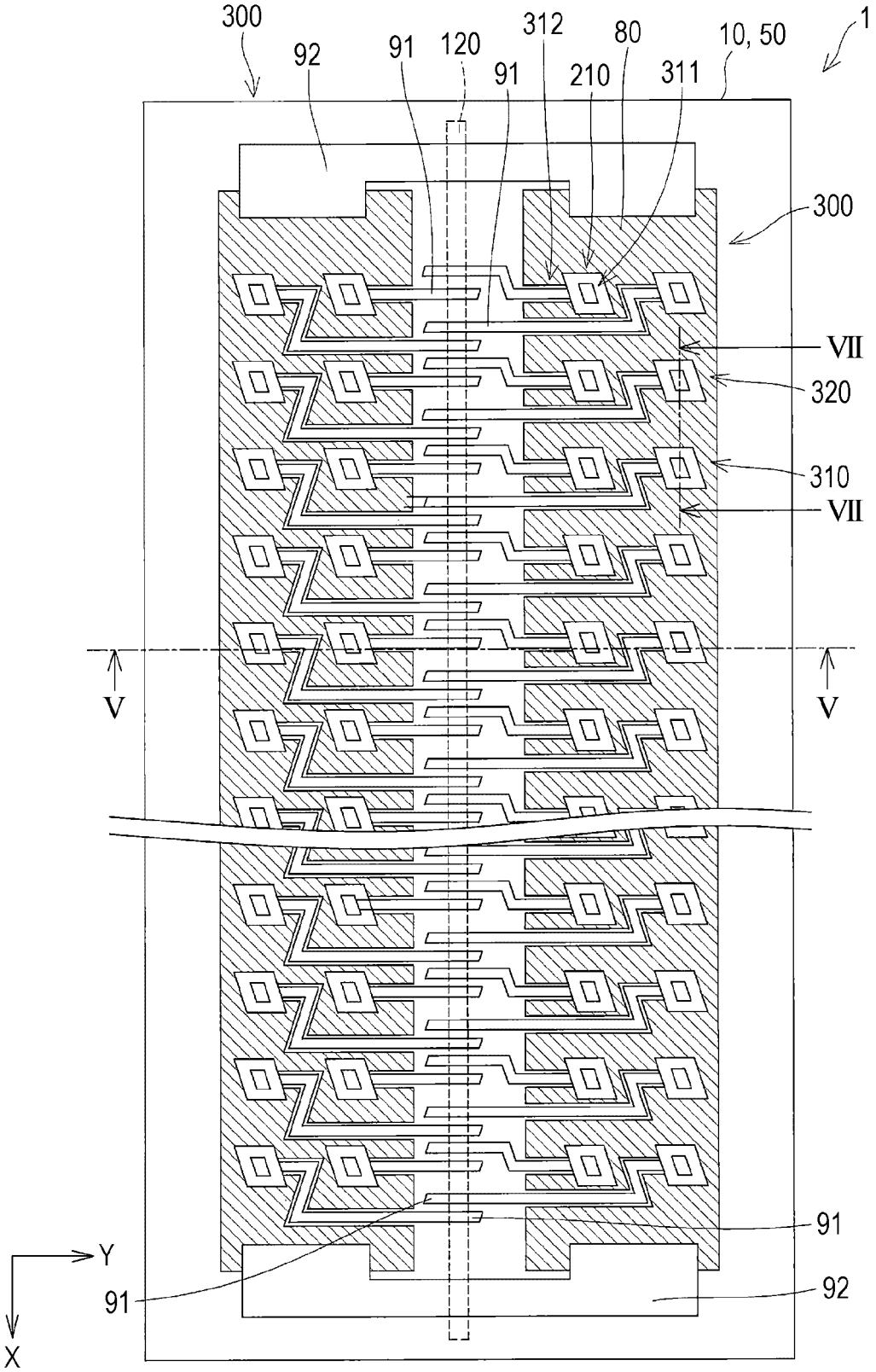
FIG. 3 is a plan view of a flow path forming substrate of the recording head according to the first embodiment of the invention.
Figure 4:
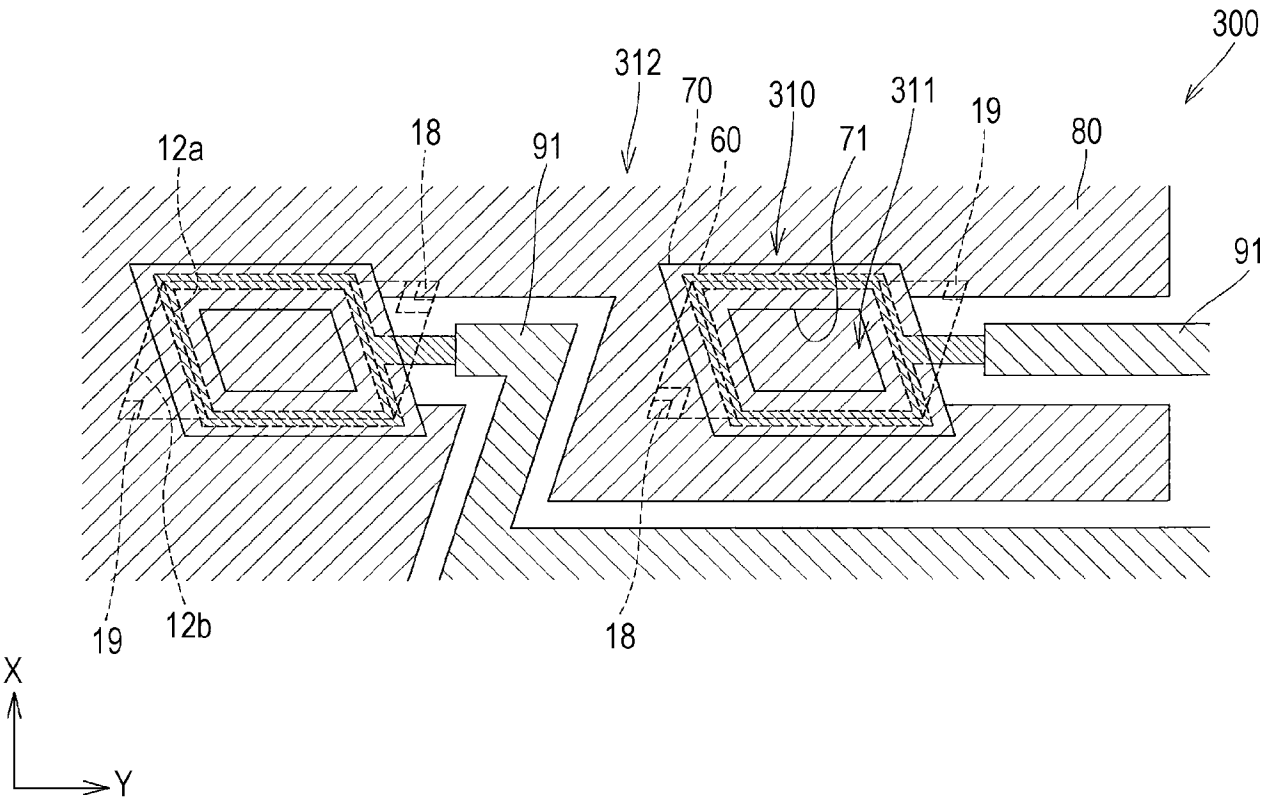
FIG. 4 is an enlarged plan view of the main portions of the flow path forming substrate according to the first embodiment of the invention.
Figure 5:
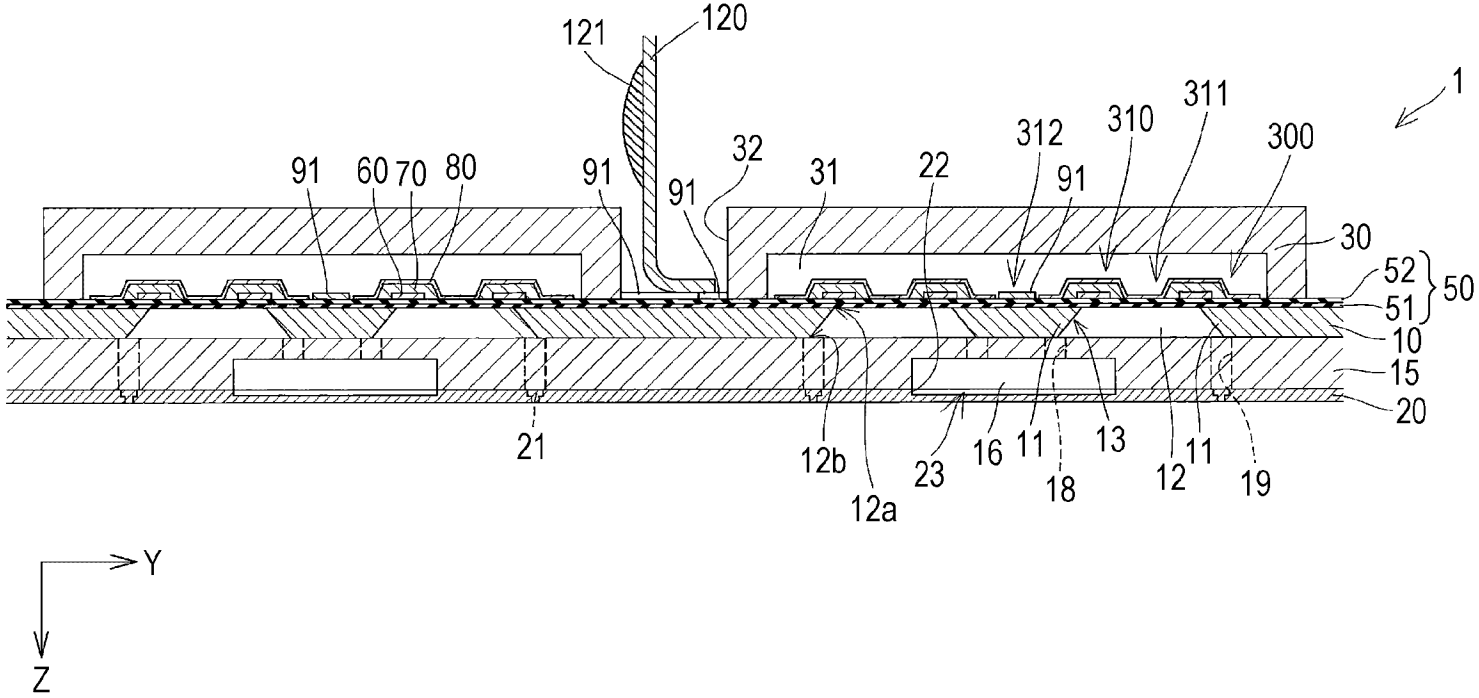
FIG. 5 is a sectional diagram of the recording head according to the first embodiment of the invention.
Figure 6:
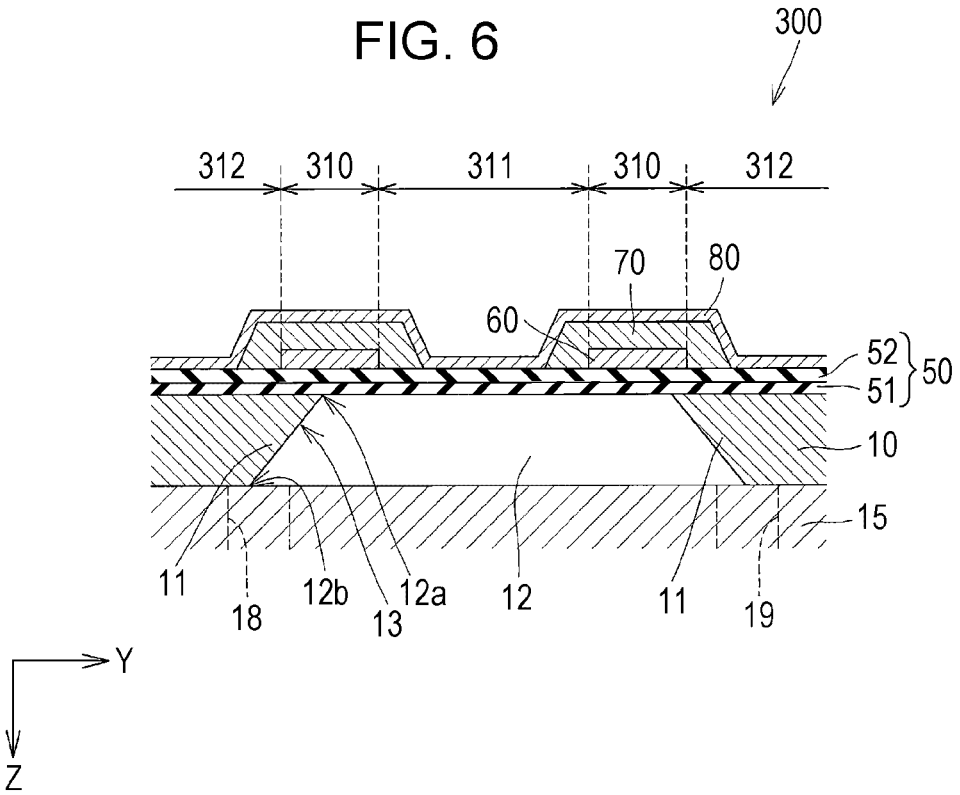
FIG. 6 is an enlarged sectional diagram of the main portions of the recording head according to the first embodiment of the invention.
Figure 7:
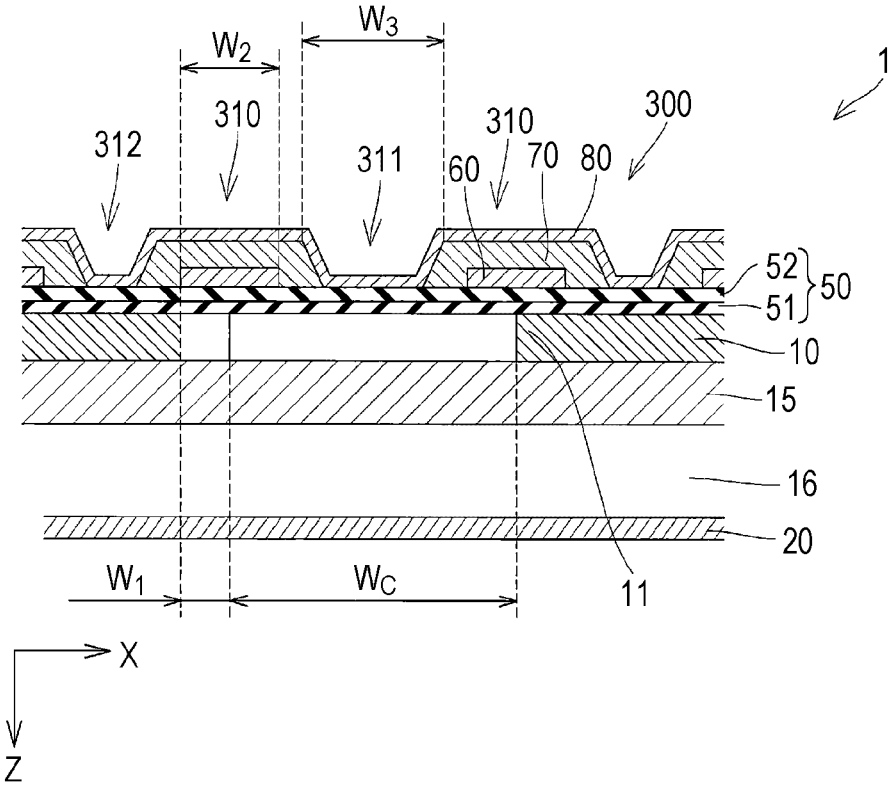
FIG. 7 is an enlarged sectional diagram of the main portions of the recording head according to the first embodiment of the invention.

Here, a description will be given of an example of the recording head 1 which is mounted in the ink jet recording apparatus I with reference to FIGS. 2 to 4. FIG. 2 is an exploded perspective diagram of an ink jet recording head which is an example of the liquid ejecting head according to the first embodiment of the invention, FIG. 3 is a plan view of the flow path forming substrate of the ink jet recording head, FIG. 4 is an enlarged diagram of the main portions of FIG. 3, FIG. 5 is a sectional diagram taken along an V-V line of FIG. 3, FIG. 6 is an enlarged sectional diagram of the main portions of FIG. 5, and FIG. 7 is a sectional diagram taken along a VII-VII line of FIG. 3. In the present embodiment, a description of the directions of the recording head 1 will be given based on the directions when the ink jet recording apparatus I is mounted, that is, based on the first direction X, the second direction Y, and the third direction Z. Naturally, the disposition of the recording head 1 inside the ink jet recording apparatus I is not limited to the disposition which is illustrated hereinafter.

As illustrated, a plurality of pressure generating chambers 12 which are formed by partitioning walls 11 are formed in a flow path forming substrate 10 which configures the ink jet recording head 1 (hereinafter also referred to as the recording head 1) which is an example of the liquid ejecting head of the present embodiment. The plurality of pressure generating chambers 12 is provided to line up along the first direction X in which a plurality of nozzles 21 which discharge the same color of ink are provided to line up. In the flow path forming substrate 10, in the second direction Y, multiple rows of the pressure generating chambers 12 are provided to line up in the first direction X and four rows are provided in the present embodiment. In the present embodiment, the rows of pressure generating chambers 12 which are provided to line up in the second direction Y are disposed at the same position in the first direction X.

The flow path forming substrate 10 of the present embodiment is formed of a silicon monocrystalline substrate having a surface with a crystalline plane azimuth of (100). The pressure generating chambers 12 are formed by subjecting the flow path forming substrate 10 to anisotropic etching from one surface side. In the present embodiment, as illustrated in FIG. 5, by subjecting the flow path forming substrate 10 which is formed of the monocrystalline substrate having a surface with a crystalline plane azimuth of (100) to anisotropic etching, the second direction Y side surfaces of the pressure generating chambers 12 form inclined surfaces 13 which are inclined with respect to the third direction Z such that the widths of the pressure generating chambers 12 become narrower toward a piezoelectric actuator 300 side. Incidentally, as illustrated in FIGS. 4 and 6, the side surfaces of the pressure generating chambers 12 in the second direction Y are surfaces which run along the third direction Z. By rendering the side surfaces of the pressure generating chambers 12 in the second direction Y surfaces which are parallel to the third direction Z, it is possible to dispose the pressure generating chambers 12 at high density in the first direction X.

As illustrated in FIG. 4, an opening 12*a* in the pressure generating chamber 12 on the piezoelectric actuator 300 side is a parallelogram when viewed in plan view from the third direction Z and an opening 12*b* in the pressure generating chamber 12 on the opposite side from the piezoelectric actuator 300, the nozzle 21 side in the present embodiment, is a parallelogram when viewed in plan view from the third direction Z. However, the opening 12*a* and the opening 12*b* of the pressure generating chamber 12 are disposed such that the corner portions which have an acute angle are reversed. In the present embodiment, the pressure generating chambers 12 are formed such that the length in the second direction Y is longer than the width in the first direction X. In other words, the pressure generating chambers 12 are formed such that the first direction X is a short direction and the second direction Y is a longitudinal direction. In other words, the length in the second direction Y is the length of the opening 12*b* in the piezoelectric actuator 300 side. Naturally, the configuration is not limited thereto, and the pressure generating chambers 12 may be configured such that the first direction X is the longitudinal direction and the second direction Y is the short direction. The pressure generating chambers 12 may be provided such that the length of the first direction X is the same as the length of the second direction Y.

In this manner, by causing the pressure generating chamber 12 to widen toward the nozzle 21, it is possible to reduce the size of the opening 12*a* of the pressure generating chamber 12 and obtain a reduction in size and an increase in density while securing the space which forms an active portion 310 (described later), and it is possible to increase the size of the opening 12*b* and secure the necessary volume for the pressure generating chamber 12.

A communicating plate 15 and a nozzle plate 20 are sequentially laminated onto the first surface side of the flow path forming substrate 10 in the third direction Z as illustrated in FIG. 5.

A manifold 16 which communicates with every two rows of the rows of pressure generating chambers 12 which are provided to line up in the first direction X is provided in the communicating plate 15. In other words, in the present embodiment, since four rows of the pressure generating chambers 12 are provided in the flow path forming substrate 10, a total of two of the manifolds 16 which communicate with every two rows of the pressure generating chambers 12 are provided.

The manifold 16 has a recessed shape which is open to the nozzle plate 20 side of the communicating plate 15 without penetrating the communicating plate 15 in the third direction Z. As illustrated in FIGS. 3 and 5, when viewed in plan view from the third direction Z, the manifold 16 is formed at a position which straddles and overlaps the two rows of pressure generating chambers 12 which communicate in the second direction Y. Incidentally, the length of the manifold 16 in the second direction Y is shorter than the length of the two rows of the pressure generating chambers 12 in the second direction Y. Although described later in detail, this is because a nozzle communicating path 19 which communicates the pressure generating chamber 12 with the nozzle 21 is provided on the outside of the manifold 16 in the second direction Y. When viewed in plan view from the third direction Z, the manifold 16 is provided to be continuous across the first direction X of the two rows of pressure generating chambers 12 which are communicated. The manifold 16, in the first direction X, is provided to extend to the outside of both end portions of the rows of pressure generating chambers 12, and the ink is introduced via inlets (refer to FIG. 2) which are provided in the communicating plate 15 at both end portions which are provided to extend.

As illustrated in FIG. 5, a supply path 18 which communicates with the manifold 16 and one end portion of the pressure generating chamber 12 in the second direction is provided in the communicating plate 15 independently for each of the pressure generating chambers 12. The supply path 18 is provided to penetrate in the third direction Z so as to communicate the bottom surface of the manifold 16 on the pressure generation chamber 12 side and the bottom surface of the pressure generation chamber 12 on the manifold 16 side. In the present embodiment, as illustrated in FIG. 4, in the two rows of pressure generating chambers 12 which communicate with the single common manifold 16, the supply paths 18 are provided to be open to an acute angle corner portion of one pressure generating chamber 12 on the other pressure generating chamber 12 side and an acute angle corner portion of the other pressure generating chamber 12 on the one pressure generating chamber 12 side. In other words, the supply paths 18 are disposed at the acute angle corner portions of the inside of the two rows of pressure generating chambers 12 in the second direction Y.

The nozzle communicating paths 19 which communicate the pressure generating chambers 12 with the nozzles 21 are provided in the communicating plate 15. The nozzle communicating paths 19 are provided independently for each of the pressure generating chambers 12. The nozzle communicating paths 19 are provided to penetrate the communicating plate 15 in the third direction Z. In the present embodiment, in the two rows of pressure generating chambers 12 which communicate with the single common manifold 16, the nozzle communicating paths 19 are provided at the acute angle corner portion of the opposite side of the one pressure generating chamber 12 from the other pressure generating chamber 12 and the acute angle corner portion of the opposite side of the other pressure generating chamber 12 from the one pressure generating chamber 12. In other words, the nozzle communicating paths 19 are disposed at the acute angle corner portions of the outside of the two rows of pressure generating chambers 12 in the second direction Y. In other words, in the opening 12*b* which is a parallelogram of the pressure generating chamber 12 on the communicating plate 15 side, the supply paths 18 are provided to be open at one corner portion of two the acute angle corner portions, and the nozzle communicating paths 19 are provided to be open at the other corner portion. In the two rows of pressure generating chambers 12, the supply paths 18 are open to each of the acute angle corner portions of the inside of the second direction Y, and the nozzle communicating paths 19 are provided to be open to each of the acute angle corner portions of the outside of the second direction Y. Therefore, the nozzle communicating paths 19 which communicate with each of the rows of pressure generating chambers 12 are disposed at different positions in the first direction X in the two rows of pressure generating chambers 12 which communicate the single common manifold 16.

In this manner, by providing the supply paths 18 and the nozzle communicating paths 19 on the respective acute angle corner portions of the openings 12*b* which are parallelograms of the pressure generating chambers 12, it is possible to suppress the retention of the ink at the acute angle corner portions in the pressure generating chambers 12 and to suppress the occurrence of discharge faults of the ink droplets caused by bubbles which are included in the ink being retained at the acute angle corner portions. In other words, by providing the supply paths 18 and the nozzle communicating paths 19 on the respective acute angle corner portions of the openings 12*b* which are parallelograms of the pressure generating chambers 12, it is possible to improve the bubble discharging properties. Incidentally, in a case in which the supply paths 18 and the nozzle communicating paths 19 are provided to communicate with the oblique corner portions or the like other than the acute angle corner portions of the openings 12*b* which are parallelograms of the pressure generating chambers 12, for example, there is a concern that the ink will be retained at the acute angle corner portions, the bubbles which are included in the ink will be retained at the acute angle corner portions and grow, the pressure fluctuations of the driving of the piezoelectric actuators 300 will be absorbed by the bubbles, and discharge faults of the ink droplets will occur.

The nozzles 21 which communicate with each of the pressure generating chambers 12 via the nozzle communicating paths 19 are formed in the nozzle plate 20. The nozzles 21 which eject the ink (the liquid) of the same type are provided line up in the first direction X to configure a nozzle row. Four nozzle rows which are configured by the nozzles 21 which are provided to line up in the first direction X are formed in the second direction Y. As described above, in the two rows of pressure generating chambers 12 which communicate with the single common manifold 16, since the nozzle communicating paths which communicate with one row of pressure generating chambers 12 are disposed at positions which are different in the first direction X from the nozzle communicating paths 19 which communicate with the other row of pressure generating chambers 12, the nozzle communicating paths 19 are also disposed at positions which are different in the first direction X at the nozzles 21 which communicate with the nozzle communicating paths 19. In other words, in the nozzle plate 20, two rows are provided to line up in the second direction Y, each of the rows having the nozzles 21 which communicate with the single common manifold 16 provided to line up in the first direction X, and the rows of nozzles 21 which are provided at different positions in the second direction Y are disposed to be shifted alternately in the first direction X. Accordingly, the nozzles 21 are disposed in a so-called zig-zag pattern along the first direction X. In this manner, it is possible to dispose the nozzles 21 at high density in the first direction X without disposing the two rows of pressure generating chambers 12 in the first direction X by rendering the openings 12*b* of the two rows of pressure generating chambers 12 parallelograms and causing the nozzle communicating paths 19 to communicate with the acute angle corner portions which have different positions in the first direction X. Therefore, it is possible to obtain a reduction in the size of the flow path forming substrate 10 and an increase in density of the nozzles 21. It is possible to increase the distance in the second direction Y between the nozzle communicating paths 19 which communicate the two rows of pressure generating chambers 12 by forming the pressure generating chambers 12 to widen toward the nozzles 21 in the third direction Z and causing the nozzle communicating paths 19 to open to the corresponding acute angle corner portions of the outside of the two rows of pressure generating chambers 12. Therefore, it is possible to dispose the manifold 16 between the two nozzle communicating paths 19 such that the manifold 16 is large in the second direction Y.

The openings of the manifold 16 on the opposite side from the pressure generating chambers 12 are sealed by the nozzle plate 20. A recessed portion 22 which is open to the manifold 16 side is provided in the nozzle plate 20 in the region which seals the openings of the manifold 16. By providing the recessed portion 22 in the nozzle plate 20 in this manner, the region which seals the manifold 16 o the nozzle plate 20 forms a compliance portion 23 which is a flexible portion which has a thinner thickness than the other regions. By providing the compliance portion 23 in the wall which forms the manifold 16 in this manner, it is possible to absorb the pressure fluctuations inside the manifold 16 through the deformation of the compliance portion 23.

Meanwhile, a diaphragm 50 is formed on the opposite surface side of the flow path forming substrate 10 from the communicating plate 15. In the present embodiment, an elastic film 51 which is provided on the flow path forming substrate 10 side and is formed of silicon oxide and an insulating film 52 which is provided on the elastic film 51 and is formed from zirconium oxide are provided as the diaphragm 50. The liquid flow path of the pressure generating chamber 12 or the like is formed by subjecting the flow path forming substrate 10 to anisotropic etching from the side of the surface to which the nozzle plate 20 is bonded, and the other surface of the pressure generating chamber 12 is formed by being partitioned by the elastic film 51. Naturally, the diaphragm 50 is not particularly limited thereto, and the diaphragm 50 may be provided on either one of the elastic film 51 and the insulating film 52, or another film may be provided.

The piezoelectric actuator 300 is provided on the diaphragm 50 of the flow path forming substrate 10 as a drive element which generates pressure changes in the ink inside the pressure generating chamber 12 of the present embodiment.

The piezoelectric actuator 300 includes a first electrode 60, a piezoelectric layer 70, and a second electrode 80 which are sequentially laminated in the third direction Z from the diaphragm 50 side. In other words, the lamination direction of the first electrode 60, the piezoelectric layer 70, and the second electrode 80 is the third direction Z.

Displacement is generated in the piezoelectric actuator 300 which is configured by the first electrode 60, the piezoelectric layer 70, and the second electrode 80 by applying a voltage between the first electrode 60 and the second electrode 80. In other words, piezoelectric strain is generated in the piezoelectric layer 70 which is interposed between the first electrode 60 and the second electrode 80 by applying a voltage between both electrodes. When a voltage is applied to both electrodes, a portion where piezoelectric strain is generated in the piezoelectric layer 70, that is, a region which is interposed between the first electrode 60 and the second electrode 80 in the third direction Z which is the lamination direction is referred to as the active portion 310. In comparison, a portion where piezoelectric strain is not generated in the piezoelectric layer 70, that is, a region which is not interposed between the first electrode 60 and the second electrode 80 in the third direction Z which is the lamination direction is referred to as an inactive portion. In the present embodiment, in the piezoelectric actuator 300, a portion at which either one of the first electrode 60 and the second electrode 80 does not overlap in the third direction Z is referred to as a non-drive portion. In other words, the non-drive portion refers to a portion in which either one of the first electrode 60 and the second electrode 80 is not formed or a portion in which both the first electrode 60 and the second electrode 80 are not formed and only the piezoelectric layer 70 is formed. In other words, the non-drive portion includes a portion in which the inactive portion of the piezoelectric layer 70 or the piezoelectric layer 70 is not formed and only one of the first electrode 60 and the second electrode 80 is formed.

In the present embodiment, although described later in detail, the active portion 310 which is a region of the piezoelectric layer 70 which is interposed between the first electrode 60 and the second electrode 80 is formed independently for each of the pressure generating chambers 12. In other words, a plurality of the active portions 310 is formed on the flow path forming substrate 10 (on the diaphragm 50). Generally, one of the electrodes of the active portion 310 is a common electrode which is shared by a plurality of the active portions 310 and the other electrode is configured as an individual electrode which is independent for each of the active portions 310. In the present embodiment, the first electrode 60 is an individual electrode and the second electrode 80 is a common electrode; however, the opposite configuration may be adopted. In other words, in the present embodiment, the first electrode 60 is set to the individual electrode by providing the first electrodes 60 independently for each of the plurality of active portions 310 and the second electrode 80 is set to the common electrode by providing the second electrode 80 continuously along the plurality of active portions 310; however, the first electrode 60 may be set to the common electrode by providing the first electrode 60 continuously along the plurality of active portions 310 and the second electrode 80 may be set to the individual electrode by providing the second electrodes 80 independently for each of the plurality of active portions 310. In the example which is described above, the diaphragm 50 and the first electrode 60 act as a diaphragm; however, naturally, the configuration is not limited thereto, and, for example, a configuration may be adopted in which only the first electrode 60 acts as the diaphragm without providing the diaphragm 50. The piezoelectric actuator 300 itself may also function effectively as the diaphragm.

Here, a more detailed description will be given of the piezoelectric actuator 300 of the present embodiment. The first electrode 60 which configures the piezoelectric actuator 300 is cut and divided for each of the pressure generating chambers 12 and configures an individual electrode which is independent for each of the active portions 310 which are the effective drive portions of the piezoelectric actuators 300.

Specifically, as illustrated in FIGS. 4, 6, and 7, the first electrodes 60 which define the active portions are provided such that at least a portion overlaps the sides of the openings of the pressure generating chambers 12 on the piezoelectric actuator 300 side, that is, the openings of the parallelograms in plan view of the third direction Z. In other words, the first electrodes 60 are formed to straddle over the partitioning walls 11 which form the pressure generating chambers 12 of the flow path forming substrate 10 and over the regions facing the pressure generating chambers 12 (inside the openings of the pressure generating chambers 12) at the sides of the openings including the parallelograms of the pressure generating chambers 12 on the piezoelectric actuator 300 side. In the present embodiment, the first electrode 60 is provided to overlap the entirety of the edges of the opening of the pressure generating chamber 12 on the piezoelectric actuator 300 side when viewed in plan view from the third direction Z.

The first electrodes 60 of the present embodiment are not provided in at least a portion of the openings of the pressure generating chambers 12 on the piezoelectric actuator 300 side. In the present embodiment, when viewed in plan view from the third direction Z, the first electrode 60 is formed such that the width thereof in the normal line direction of the sides of the opening of the pressure generating chamber 12 on the piezoelectric actuator 300 side is the same width toward a direction along the sides, and the first electrode 60 is not formed at the center portion of the opening of the pressure generating chamber 12 on the piezoelectric actuator 300 side.

The piezoelectric layer 70 is formed of an oxide piezoelectric material which is formed on the first electrode 60 and has a polarized structure, for example, it is possible to form the piezoelectric layer 70 of a perovskite-type oxide which is illustrated by general formula $ABO_3$. It is possible to use a lead-based piezoelectric material which contains lead, a non lead-based piezoelectric material which does not contain lead, or the like, for example, as the perovskite-type oxide which is used in the piezoelectric layer 70.

In the present embodiment, as illustrated in FIGS. 6 and 7, the piezoelectric layer 70 is provided independently for each of the pressure generating chambers 12, that is, for each of the active portions 310. The piezoelectric layer 70 has a size which is large enough to cover the end portions of the first electrode 60 excluding the portion which leads out. In the present embodiment, a recessed portion 71 is formed in a portion (a non-drive portion 311) in which the first electrode 60 is not formed in the center portion of the opening of the pressure generating chamber 12 of the piezoelectric layer 70 on the piezoelectric actuator 300 side.

In the present embodiment, the piezoelectric layer 70 is cut up and provided independently for each of the active portions 310; however, the configuration is not particularly limited thereto, and the piezoelectric layer 70 may be provided continuously across the plurality of active portions 310.

The second electrode 80 is provided on the opposite surface side of the piezoelectric layer 70 from the first electrode 60 and configures a common electrode which is shared by the plurality of active portions 310. In the present embodiment, the second electrode 80 is provided continuously across the plurality of active portions 310 on the piezoelectric layer 70 and on the diaphragm 50. The second electrode 80 is provided continuously on the inside of the recessed portion 71 of the piezoelectric layer 70, that is, across the side surface of the recessed portion 71 and on the diaphragm 50 inside the recessed portion 71. As described above, by forming the second electrode on the piezoelectric layer 70 and on the diaphragm 50, the second electrode 80 is formed closer to the outside of the first electrode 60 than the end portions. Therefore, the active portion 310 of the present embodiment is defined by the first electrode 60. However, as illustrated in FIG. 3, the second electrode 80 is not formed on the portion which leads out the first electrode 60 from the active portion 310, and the active portion 310 is defined by the second electrode 80 in this portion.

In the piezoelectric actuator 300 having the first electrode 60, the piezoelectric layer 70, and the second electrode 80, the portion in which the first electrode 60 is provided forms the active portion 310 and the portion in which the first electrode 60 is not formed and either one or both of the piezoelectric layer 70 and the second electrode 80 are not provided forms non-drive portions 311 and 312. In the present embodiment, the active portion 310 is provided to overlap the entirety of the edges of the opening of the pressure generating chamber 12 on the piezoelectric actuator 300 side of the parallelogram when viewed in plan view from the third direction Z. In other words, the active portions 310 are formed to straddle over the partitioning walls 11 which form the pressure generating chambers 12 of the flow path forming substrate 10 and over the regions facing the pressure generating chambers 12 (inside the openings of the pressure generating chambers 12) at the sides of the openings including the parallelograms of the pressure generating chambers 12 on the piezoelectric actuator 300 side.

As illustrated in FIG. 4, by not forming the first electrode 60 at the center portion of the opening 12*a* of the pressure generating chamber 12 on the piezoelectric actuator 300 side, the non-drive portion 311 at which the first electrode 60 and the second electrode 80 do not overlap each other is formed at this portion. The first electrode 60 which defines the active portion 310 of the present embodiment is formed such that the width in the normal line direction of the sides of the opening 12*a* of the pressure generating chamber 12 on the piezoelectric actuator 300 side when viewed in plan view from the third direction Z is the same width toward a direction along the sides. Therefore, the non-drive portion 311 has the same shape as the opening 12*a*, that is, is a parallelogram with a narrower area than the opening of the pressure generating chamber 12 of the piezoelectric actuator 300 side. As described above, the recessed portion 71 is formed in the piezoelectric layer 70 of the non-drive portion 311. In other words, therefore, the hindrance of the deformation of the non-drive portion 311 by the piezoelectric layer 70 is suppressed, the non-drive portion 311 may deform more easily, and the active portion 310 may deform more easily. Incidentally, the non-drive portion 312 at which only the second electrode 80 is formed is present without the first electrode 60 being formed on the partitioning walls 11.

As illustrated in FIG. 3, individual wirings 91 which are lead-out wirings are lead out from the first electrodes 60 which are the individual electrodes of each of the active portions 310. In the present embodiment, the individual wirings 91 are lead out toward the center portion in the second direction Y of the flow path forming substrate 10.

The second electrodes 80 are provided continuously at the portions other than the individual wirings 91, and common wirings 92 are lead out from the second electrodes 80 toward the center portions in the second direction Y of the flow path forming substrate 10 at both sides in the first direction X of the active portions 310. A flexible cable 120 is connected to the individual wirings 91 and the common wirings 92. The flexible cable 120 is a flexible wiring substrate, and in the present embodiment, a drive circuit 121 which is a semiconductor element is installed.

As illustrated in FIG. 5, a protective substrate 30 is bonded to the surface of the flow path forming substrate 10 on the piezoelectric actuator 300 side. The protective substrate 30 includes a holding portion 31 which is a space for protecting the piezoelectric actuator 300. Two of the holding portions 31 are formed to line up in the second direction Y, each being provided for one of the two rows of active portions 310 which are provided to line up in the first direction X. In other words, the two rows of active portions 310 are disposed inside the single holding portion 31. A through hole 32 which penetrates the protective substrate 30 in the third direction Z is provided in the protective substrate 30 between the two holding portions 31 which are provided to line up in the second direction Y. The individual wirings 91 which are lead out from the first electrode 60 of the piezoelectric actuator 300 and the end portions of the common wirings 92 which are lead out from the second electrodes 80 are provided to extend to be exposed to the inside of the through holes 32 and are electrically connected to the flexible cable 120 inside the through holes 32.

In the recording head 1, when the ink is ejected, the ink is taken in from the inlets 17 and the inner portion of the flow paths from the manifolds 16 to the nozzles 21 are filled with the ink. Subsequently, by applying a voltage to each of the piezoelectric actuators 300 which correspond to the pressure generating chambers 12 according to the signals from the drive circuit 121, the diaphragms 50 are caused to flex and deform together with the piezoelectric actuators 300. Accordingly, the pressure inside the pressure generating chambers 12 increases and the ink droplets are ejected from the predetermined nozzles 21.

As described above, the active portion 310 overlaps at least a portion of the edge of each of the sides of the opening 12*a* of the pressure generating chamber 12 on the piezoelectric actuator 300 side and has the non-drive portion 311 on at least a portion of the opening 12*a* when viewed in plan view from the third direction Z, and thus, it is possible to improve the displacement efficiency of the piezoelectric actuator 300 with respect to the length of the pressure generating chamber 12 in the second direction Y which is the longitudinal direction. Incidentally, in a case in which the active portion 310 of the piezoelectric actuator 300 is provided to not overlap the edge portions of the opening 12*a*, that is, is provided at a position which overlaps the center portion of the pressure generating chamber 12 when viewed in plan view, in order to improve the displacement amount of the piezoelectric actuator 300, it is necessary to lengthen the pressure generating chamber 12 in the second direction Y and to form the piezoelectric actuator 300 to be long in the second direction Y and the displacement efficiency of the piezoelectric actuator 300 is poor with respect to the length in the second direction Y. In the present embodiment, even if the length of the pressure generating chamber 12 in the second direction Y is shortened by providing the active portion 310 to overlap at least a portion of the edges of each of the sides of the opening 12*a*, it is possible to suppress a reduction in the displacement characteristics. Therefore, it is possible to obtain a reduction in the size of the flow path forming substrate 10 and a reduction in the size of the recording head 1. Since it is possible to shorten the length of the pressure generating chamber 12 in the second direction Y, it is possible to dispose a plurality of the rows of the pressure generating chambers 12, which are provided to line up in the first direction X, in rows in the second direction Y, and it is possible to obtain a reduction in size and an increase in the number of nozzles.

In the present embodiment, the active portion 310 is provided to overlap the entirety of the edge of the opening 12*a* when viewed in plan view from the third direction Z. Therefore, it is possible to easily perform the pulling out and routing of the wiring from the individual electrode of the active portion 310, in the present embodiment, from the first electrode 60. Incidentally, in a case in which the active portion 310 is provided non-continuously at the edges of the opening 12*a*, when the first electrode 60 is divided, the leading out of the wiring from the first electrode 60 increases and the routing of the individual wiring 91 becomes difficult. Therefore, in a case in which the active portion 310 is provided non-continuously at the edges of the opening 12*a*, the first electrode 60 may be provided continuously at the edges of the opening 12*a*, and the second electrode 80 may be provided such that a portion is non-continuous at the edges of the opening 12*a*. In this case, it is possible to easily perform the leading out and the routing of the wiring from the first electrode 60 which is the individual electrode.

The opening 12*a* of the pressure generating chamber 12 on the piezoelectric actuator 300 side is a parallelogram when viewed in plan view from the third direction Z. In particular, it is possible to form the pressure generating chambers 12 with high precision and at high density by subjecting the monocrystalline silicon substrate which has a surface with a crystalline plane azimuth of (100) to anisotropic etching to form the pressure generating chambers 12.

In the present embodiment, the active portion 310 is formed such that the width in the normal line direction of the sides of the opening 12*a* of the pressure generating chamber 12 on the piezoelectric actuator 300 side is the same width toward a direction along the sides when viewed in plan view from the third direction Z. Therefore, the non-drive portion 311 has the same shape as the opening 12*a*, that is, is a parallelogram with a narrower area than the opening of the pressure generating chamber 12 on the piezoelectric actuator 300 side and is provided at the center portion of the opening 12*a*. In this manner, by providing the non-drive portion 311 at the center portion of the opening 12*a* in the same shape as the opening 12*a*, it is possible to cause the active portion 310 to deform easily. Naturally, the non-drive portion 311 may be the same shape as the opening 12*b* of the pressure generating chamber 12 and may be provided at a portion other than the center portion of the opening 12*a*.

Since the active portion 310 and the non-drive portion 311 are defined by the first electrode 60, the non-drive portion 311 does not include the first electrode 60. The recessed portion 71 is provided in the piezoelectric layer 70 of the non-drive portion 311. Therefore, at least a portion of the non-drive portion 311 does not include the first electrode 60 and the piezoelectric layer 70. In this manner, due to at least a portion of the non-drive portion 311 not including the first electrode 60 and the piezoelectric layer 70, the hindrance of the deformation of the non-drive portion 311 by the piezoelectric layer 70 is suppressed, the non-drive portion 311 may deform more easily, and the active portion 310 may deform more easily.

In the present embodiment, as illustrated in FIG. 6, when viewed in plan view from the third direction Z, the end portion of the active portion 310, in the present embodiment, the end portion of the first electrode 60 is provided at a position which overlaps the inclined surface 13. In this manner, by providing the end portion of the active portion 310 above the inclined surface 13 in the third direction Z, the boundary between the active portion 310 and the non-drive portion 312 is positioned above the inclined surface 13. Since the thickness of the flow path forming substrate 10 in the third direction Z gradually increases toward the outside from the pressure generating chambers 12 due to the inclined surfaces 13, the rigidity of the portions at which the inclined surfaces 13 of the flow path forming substrate 10 are provided gradually increases toward the outside from the pressure generating chambers 12. Therefore, when the active portion 310 is driven, the stress of the boundary portion between the active portion 310 and the non-drive portion 312 is mitigated by the deformation of the inclined surface 13. In particular, although the region in which the inclined surface 13 is provided deforms, since the rigidity of the flow path forming substrate 10 gradually increases from the pressure generating chamber 12 side toward the outside due to the inclined surface 13, the flow path forming substrate 10 which is provided with the inclined surface 13 deforms more easily the closer to the active portion 310 side and deforms less easily the closer to the non-drive portion 312 side. Therefore, it is possible to effectively mitigate the focusing of stress between the active portion 310 and the non-drive portion 312 due to the deforming of the flow path forming substrate 10 which is provided with the inclined surface 13, and it is possible to suppress the occurrence of stress focusing at the boundary between the active portion 310 and the non-drive portion 312 and to suppress the destruction.

Here, as illustrated in FIG. 7, when viewed in plan view from the third direction Z side, it is preferable that a width $W_1$ which overlaps the partitioning wall 11 of the first electrode 60 which defines the active portion 310 in the normal line direction of the side of the opening 12*a* of the pressure generating chamber 12 be greater than or equal to the thickness of the piezoelectric layer 70 in the third direction Z and less than or equal to 10 μm. For example, when the thickness of the piezoelectric layer 70 is thickened, the tensile stress which is the internal stress of the active portion 310 increases when the active portion 310 is driven. At this time, when the width $W_1$ of the first electrode 60 above the partitioning wall 11, that is, the width $W_1$ of the active portion 310 above the partitioning wall 11 is narrow, the boundary between the active portion 310 and the non-drive portion 312 above the partitioning wall 11 approaches the edge portion of the opening of the pressure generating chamber 12 and there is a concern that destruction will occur at the boundary between the active portion 310 and the non-drive portion 312. Therefore, it is preferable that the width $W_1$ of the active portion 310 above the partitioning wall 11 be greater than or equal to the thickness of the piezoelectric layer 70. When the width $W_1$ of the first electrode 60, that is, the active portion 310 above the partitioning wall 11 is too great, the capacity of the active portion 310 increases and the power consumption increases. Therefore, it is preferable that the width $W_1$ of the active portion 310 above the partitioning wall 11 be less than or equal to 10 μm. As illustrated in FIG. 7, the width $W_1$ which overlaps the partitioning wall 11 of the active portion 310 is not only the width with respect to the sides which are provided on both sides in the second direction Y, but also the same applies to the width with respect to the sides which are provided on both sides in the first direction X as illustrated in FIG. 6.

As illustrated in FIG. 7, when viewed in plan view from the third direction Z, it is preferable that a width $W_2$ in which the first electrode 60 which defines the active portion 310 is provided to straddle the opening 12*a* of the pressure generating chamber 12 be within a range of greater than or equal to 0.2 times and less than or equal to 0.5 times a width $W_c$ of the pressure generating chamber 12 in the first direction X which is the short direction. As illustrated in FIG. 7, the width $W_2$ in which the active portion 310 straddles the opening 12*a* is not only the width with respect to the sides which are provided on both sides in the second direction Y, but also the same applies to the width with respect to the sides which are provided on both sides in the first direction X as illustrated in FIG. 6.

As illustrated in FIG. 7, when viewed in plan view from the third direction Z, it is preferable that the recessed portion 71 which is open to the opposite side from the flow path forming substrate 10 be provided in the piezoelectric layer 70 of the non-drive portion 311, and that a width $W_3$ of the recessed portion 71 be within a range of greater than or equal to 0.1 times and less than or equal to 0.5 times the width $W_c$ of the pressure generating chamber 12 in the first direction X which is the short direction of the pressure generating chamber 12. It is possible to optimize the displacement efficiency of the active portion 310 by defining the width $W_2$ of the active portion 310 and the width $W_3$ of the recessed portion 71 of the piezoelectric layer 70 which is provided in the non-drive portion 311. In other words, the displacement efficiency of the active portion is reduced by setting the active portion 310 and the non-drive portion 311 outside of the ranges described above. The width $W_3$ of the recessed portion 71 is the width at the opening portion on the opposite side from the flow path forming substrate 10. As illustrated in FIG. 7, the width $W_3$ of the recessed portion 71 is not only the width between the sides which are provided on both sides in the second direction Y, but also the same applies to the width with respect to the sides which are provided on both sides in the first direction X as illustrated in FIG. 6.

As illustrated in FIG. 4, the active portion 310 is disposed at a position which does not overlap the nozzle 21 when viewed in plan view from the third direction Z. In other words, when viewed in plan view from the third direction Z, the nozzle 21 is disposed on the outside of the active portion 310 and the inside of the pressure generating chamber 12. Due to the active portion 310 being set to a position which does not overlap the nozzle 21, the overlapping amount of the active portion 310 above the partitioning wall 11 is restricted and it is possible to suppress the electrical capacitance of the active portion 310 from becoming too great and to reduce the power consumption. When viewed in plan view from the third direction Z, it is possible to suppress the increase in the sizes of the flow path forming substrate 10 and the nozzle plate 20 by disposing the nozzle 21 on the inside of the pressure generating chamber 12, that is by disposing the nozzle 21 at a position which does not overlap the pressure generating chamber 12.

In the present embodiment, the pressure generating chamber 12 communicates with the nozzle 21 on the opposite side from the piezoelectric actuator 300 in the third direction Z and the active portion 310 is disposed at a position at which at least a portion of the opening of the pressure generating chamber 12 on the nozzle 21 side does not overlap the active portion 310. In other words, the pressure generating chamber 12 is provided to widen toward the opening 12*b* of the nozzle 21 side. In the present embodiment, the pressure generating chamber 12 widens toward the opening 12*b* of the nozzle 21 side due to the inclined surface 13. In this manner, by causing the pressure generating chamber 12 to widen toward the nozzle 21 side, it is possible to reduce the size of the opening 12*a* of the pressure generating chamber 12 and to obtain a reduction in size while securing the space to form the active portion 310 and it is possible to increase the size of the opening 12*b* and secure the necessary volume for the pressure generating chamber 12.

In the present embodiment, as illustrated in FIG. 4, in the third direction Z, in the pressure generating chamber 12, the opening 12*b* of the opposite surface side from the piezoelectric actuator 300 is a parallelogram and the nozzle communicating path 19 which communicates with the nozzle 21 is connected to the supply path 18 which supplies the ink to the pressure generating chamber 12 at each of the acute angle corner portions of the parallelogram. In this manner, by connecting the nozzle communicating path 19 and the supply path 18 on the respective acute angle corner portions of the pressure generating chamber 12, it is possible to suppress the retention of the ink at the acute angle corner portions and to suppress the occurrence of discharge faults of the ink droplets caused by bubbles which are included in the ink being retained at the acute angle corner portions.

It is possible to increase the distance in the second direction Y between the nozzle communicating paths 19 which communicate the two rows of pressure generating chambers 12 due to the pressure generating chambers 12 widening toward the nozzles 21 and by causing the nozzle communicating paths 19 to open to the corresponding acute angle corner portions of the outside of the two rows of pressure generating chambers 12 which communicate with the single common manifold 16. Therefore, it is possible to dispose the manifold 16 which communicates in common with the two rows of pressure generating chambers 12 between the two nozzle communicating paths 19 such that the manifold 16 is large in the second direction Y.

Figure 8:
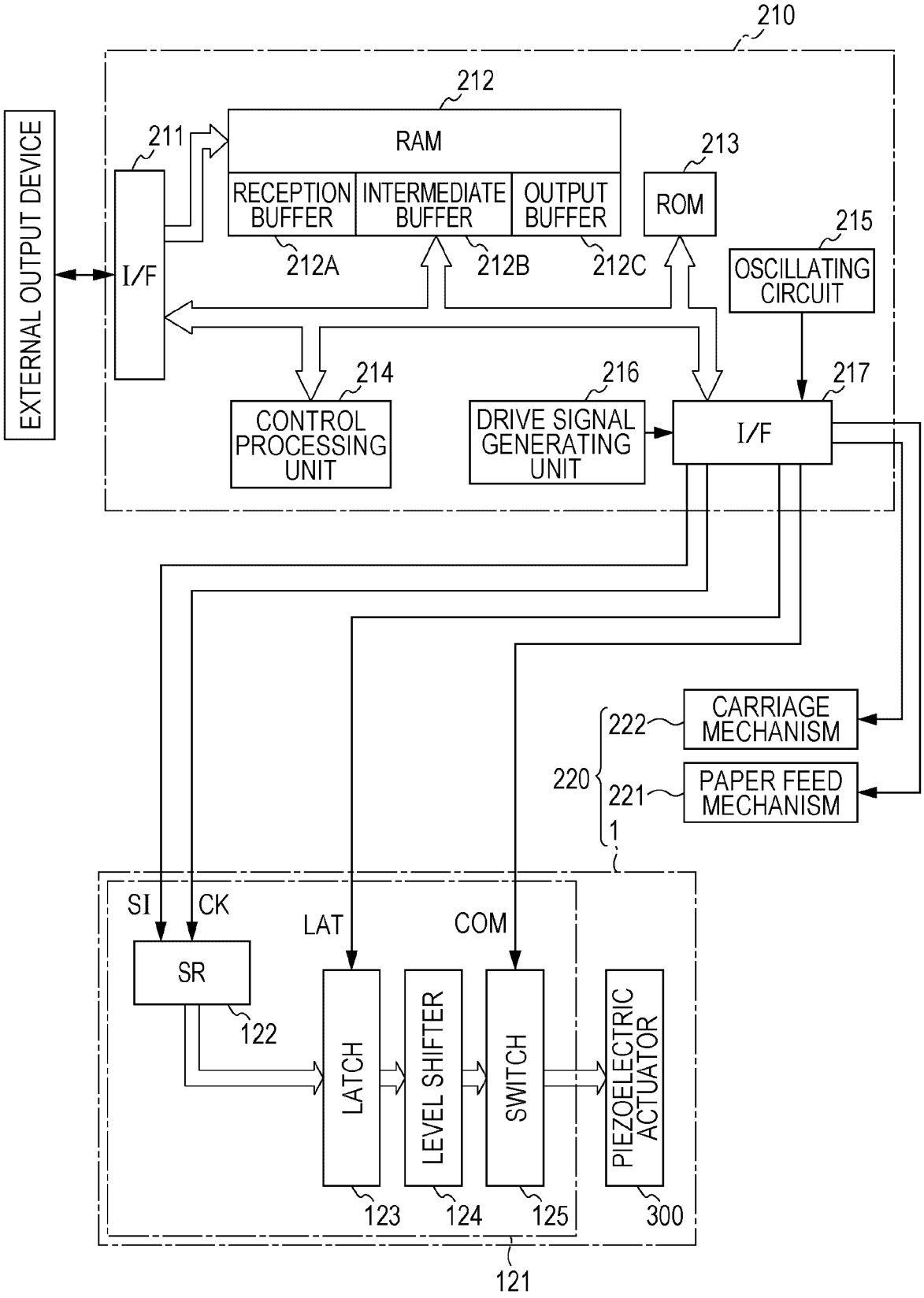
FIG. 8 is a block diagram illustrating the control configuration of the recording apparatus according to the first embodiment of the invention.

As illustrated in FIG. 1, the ink jet recording apparatus I includes a control device 200. Here, a description will be given of the electrical configuration of the ink jet recording apparatus I of the present embodiment with reference to FIG. 8. FIG. 8 is a block diagram illustrating the control configuration of the ink jet recording apparatus according to the first embodiment of the present embodiment.

As illustrated in FIG. 8, the ink jet recording apparatus I is provided with a printer controller 210, which is the control unit of the present embodiment, and a print engine 220.

The printer controller 210 is an element which controls the entirety of the ink jet recording apparatus I, and in the present embodiment, is provided inside the control device 200 which is provided in the ink jet recording apparatus I.

The printer controller 210 is provided with an external interface 211 (hereinafter referred to as the external I/F 211), a RAM 212 which temporarily stores various data, a ROM 213 which stores control programs and the like, a control processing unit 214 which is configured to include a CPU and the like, an oscillating circuit 215 which generates a clock signal, a drive signal generating unit 216 which generates a drive signal for supplying to the recording head 1, and an internal interface 217 (hereinafter referred to as the internal I/F 217) which transmits dot pattern data (bitmap data) which is expanded based on the drive signal and the print data to the print engine 220.

The external I/F 211 receives the print data which is configured by character codes, graphic functions, image data, and the like, for example, from an external device 230 such as a host computer. Busy signals (BUSY) and acknowledgment signals (ACK) are output to the external device 230 through the external I/F 211.

The RAM 212 functions as a reception buffer 212A, an intermediate buffer 212B, an output buffer 212C, and a work memory (not illustrated). The reception buffer 212A temporarily stores the print data which is received by the external I/F 211, the intermediate buffer 212B stores intermediate code data which is converted by the control processing unit 214, and the output buffer 212C stores dot pattern data. The dot pattern data is configured by printing data which is obtained by decoding (translating) gradation data.

In addition to control programs (control routines) for causing various data processes to be performed, the ROM 213 stores font data, graphic functions, and the like in advance.

The control processing unit 214 reads the print data in the reception buffer 212A and causes the intermediate code data which is obtained by converting the print data to be stored in the intermediate buffer 212B. The intermediate code data which is read from the intermediate buffer 212B is analyzed and the intermediate code data is expanded into the dot pattern data with reference to the font data, graphic functions, and the like which are stored in the ROM 213. The control processing unit 214 performs the necessary auxiliary processes and subsequently stores the expanded dot pattern data in the output buffer 212C.

If one line worth of the dot pattern data is obtained by the recording head 1, the one line worth of dot pattern data is output to the recording head 1 through the internal I/F 217. When the one line worth of dot pattern data is output from the output buffer 212C, the expanded intermediate code data is erased from the intermediate buffer 212B and the expanding process is performed for the next item of intermediate code data.

The print engine 220 is configured to include the recording head 1, a paper feed mechanism 221, and a carriage mechanism 222. The paper feed mechanism 221 is configured by the transport roller 8, a motor (not illustrated) which drives the transport roller 8, and the like and sequentially feeds out the recording sheet S in cooperation with the recording operation of the recording head 1. In other words, the paper feed mechanism 221 moves the recording sheet S relative to the first direction X. The carriage mechanism 222 includes the carriage 3, the drive motor 6 which causes the carriage 3 to move in the second direction Y along the carriage shaft 5, and the timing belt 7.

The recording head 1 is provided with the drive circuit 121 which includes a shift register 122, a latch circuit 123, a level shifter 124, and a switch 125, and the piezoelectric actuator 300. The shift register 122, the latch circuit 123, the level shifter 124, and the switch 125 generate an application pulse from the drive signal which is generated by the drive signal generating unit 216. Here, the application pulse is actually applied to the piezoelectric actuator 300.

Figure 9:
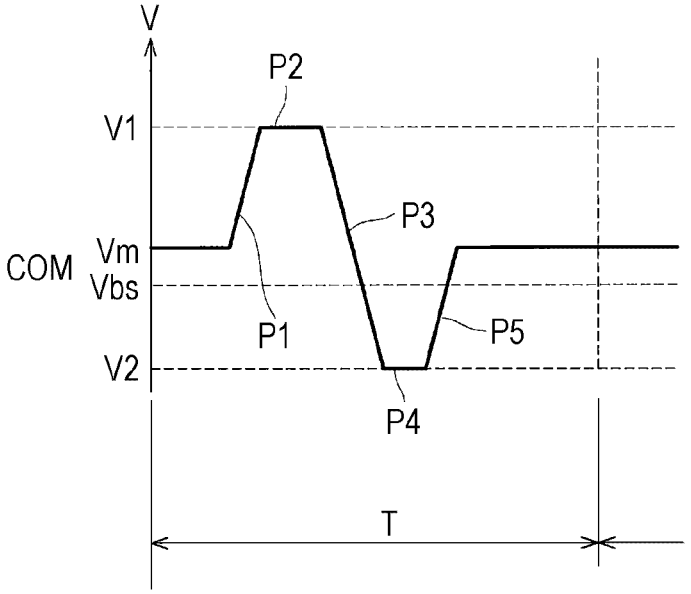
FIG. 9 is a drive waveform illustrating a drive signal according to the first embodiment of the invention.

Here, a description will be given of the drive signal which includes the drive waveform which is generated by the drive signal generating unit 216. FIG. 9 is a drive waveform illustrating the drive signal.

As illustrated in FIG. 9, a drive signal COM of the present embodiment is repeatedly generated from the drive signal generating unit 216 for every unit period T (the discharge period T) which is defined by the clock signal which is emitted from the oscillating circuit 215. The unit period T corresponds to one pixel worth of the image or the like to be printed onto the recording sheet S. When one line worth (one raster worth) of the dot pattern is formed in the recording region of the recording sheet S during the printing, the drive signal is selectively applied to the piezoelectric actuator 300 corresponding to each of the nozzles 21. In the present embodiment, the drive signal is supplied to the first electrode 60 which is the individual electrode using the second electrode 80 which is the common electrode of the piezoelectric actuator 300 as a reference potential (Vbs). In other words, the voltage which is applied to the first electrode 60 by the drive waveform is represented as the potential which is based on the reference potential (Vbs).

Specifically, the drive signal COM includes an expanding element P1, an expansion maintenance element P2, a contracting element P3, a contraction maintenance element P4, and an expanding recovery element P5. The expanding element P1 charges from a reference potential Vm to a first potential V1 to cause the volume of the pressure generating chamber 12 to expand from the reference volume, the expansion maintenance element P2 maintains the volume of the pressure generating chamber 12 which is expanded by the expanding element P1 for a fixed time, the contracting element P3 discharges from the first potential V1 to a second potential V2 to cause the volume of the pressure generating chamber 12 to contract, the contraction maintenance element P4 maintains the volume of the pressure generating chamber 12 which is contracted by the contracting element P3 for a fixed time, and the expanding recovery element P5 causes the pressure generating chamber 12 to recover from the contracted state of the second potential V2 to the reference volume of the reference potential Vm.

In the present embodiment, the potential difference of the expanding element P1, that is, the potential difference between the reference potential Vm and the first potential V1 is smaller than the potential difference of the contracting element P3, that is, the potential difference between the first potential V1 and the second potential V2.

Figure 10:
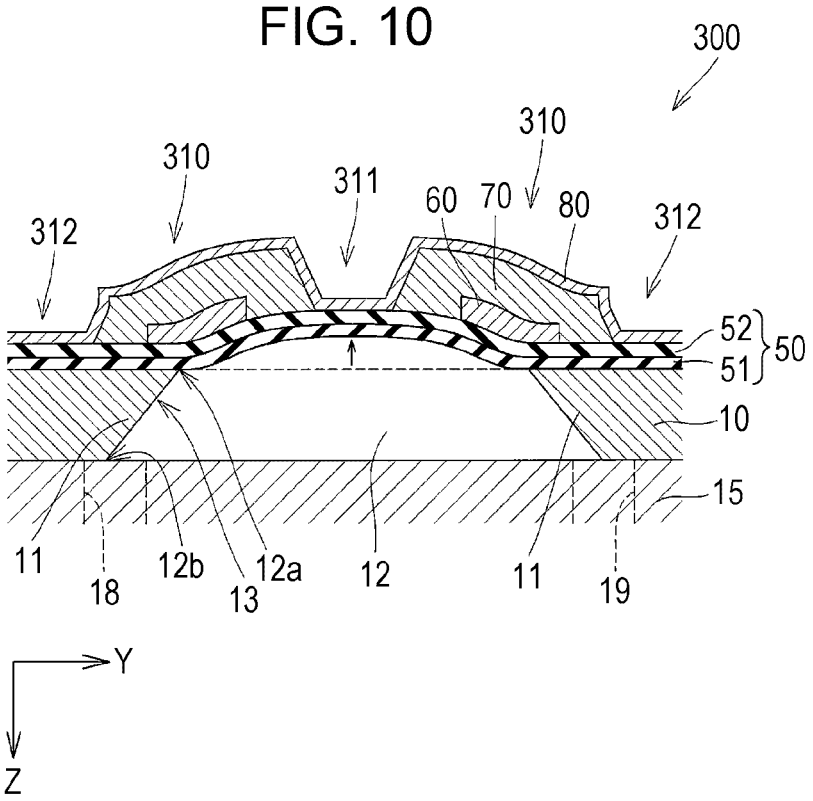
FIG. 10 is a diagram illustrating an operation of a piezoelectric actuator according to the first embodiment of the invention.
Figure 11:
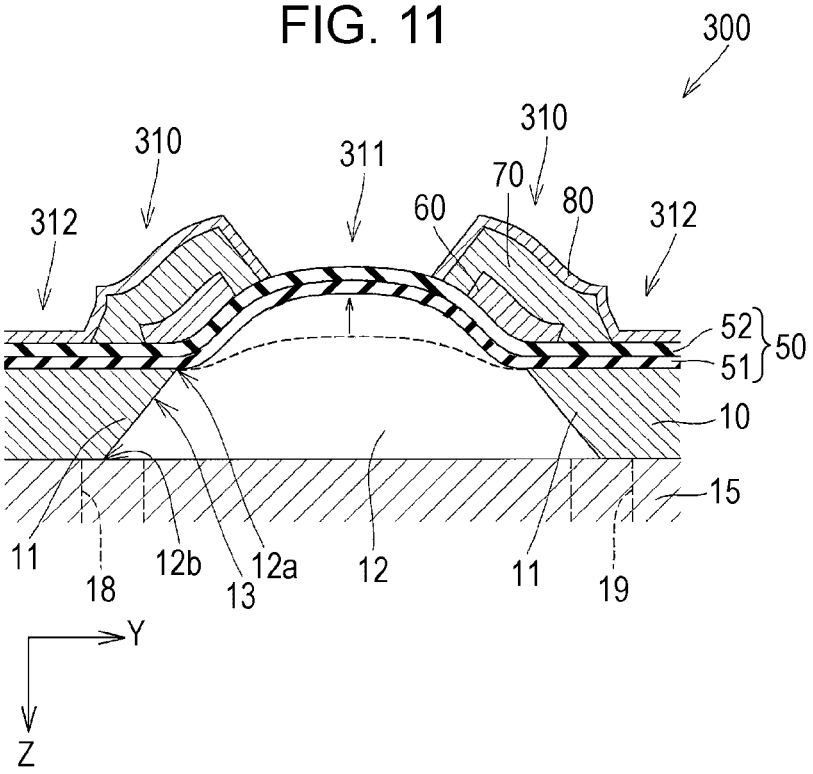
FIG. 11 is a diagram illustrating an operation of the piezoelectric actuator according to the first embodiment of the invention.
Figure 12:
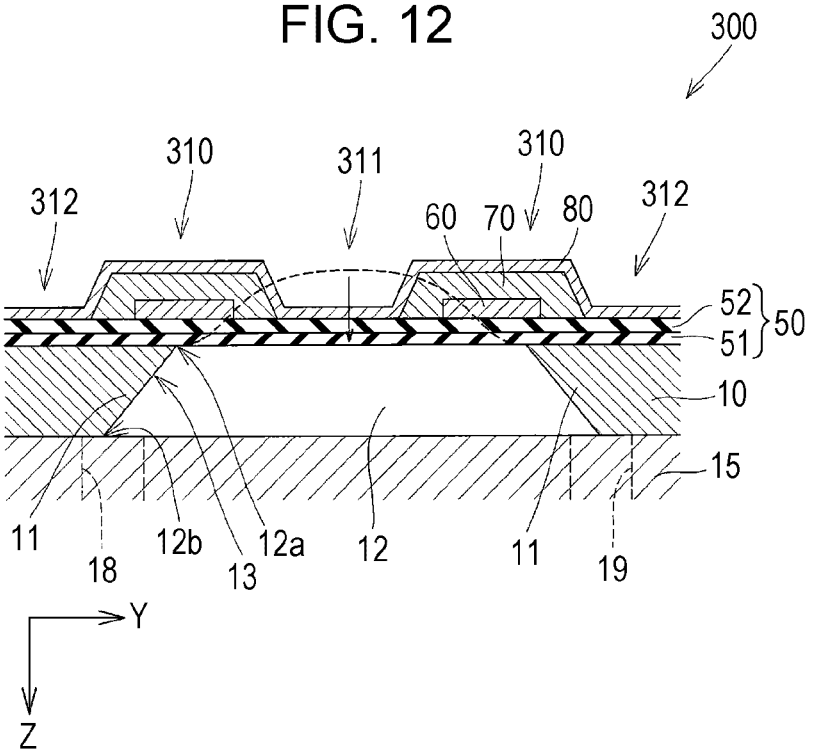
FIG. 12 is a diagram illustrating an operation of the piezoelectric actuator according to the first embodiment of the invention.

When the drive signal COM is supplied to the piezoelectric actuator 300, by charging the piezoelectric actuator 300 with the reference potential Vm, as illustrated in FIG. 10, the pressure generating chamber 12 is expanded from the original volume to the reference volume. Next, by charging the piezoelectric actuator 300 with the expanding element P1, as illustrated in FIG. 11, the piezoelectric actuator 300 is caused to deform to the opposite side from the pressure generating chamber 12 and the pressure generating chamber 12 expands more from the reference volume. By discharging the piezoelectric actuator 300 using the contracting element P3, as illustrated in FIG. 12, the volume of the pressure generating chamber 12 contracts to the original volume (the non-charged volume) and an ink droplet is discharged from the nozzle 21.

In this manner, according to the piezoelectric actuator 300 and the drive signal COM of the present embodiment, since the piezoelectric actuator 300 deforms to the opposite side from the pressure generating chamber 12 due to the expanding element P1, it is possible to set the internal stress of the piezoelectric actuator 300 to the contraction stress. Since the piezoelectric actuator 300 is only restored to the original shape by the contracting element P3, it is possible to suppress the internal stress of the piezoelectric actuator 300 from becoming a tensile stress. Incidentally, when the piezoelectric actuator 300 is caused to flex and deform inside the pressure generating chamber 12, the inner portion of the piezoelectric actuator 300 is subjected to tensile stress. Since the piezoelectric layer 70 has a crystalline structure, the piezoelectric layer 70 is frailer to tensile stress than compressive stress. Therefore, by causing the piezoelectric actuator 300 to deform to the opposite side from the pressure generating chamber 12 and setting the internal stress to a compressive stress, it is possible to suppress destruction of the piezoelectric actuator 300 by internal stress. The potential difference which is applied by the expanding element P1 is smaller than the potential difference which is applied by the contracting element P3, and since the contracting element P3 only restores the piezoelectric actuator 300 to the original shape in which a voltage is not being applied, it is possible to reduce the internal stress from the expanding element P1 to the contracting element P3. Therefore, it is possible to suppress the destruction of the piezoelectric actuator 300 by internal stress.

Second Embodiment

Figure 13:
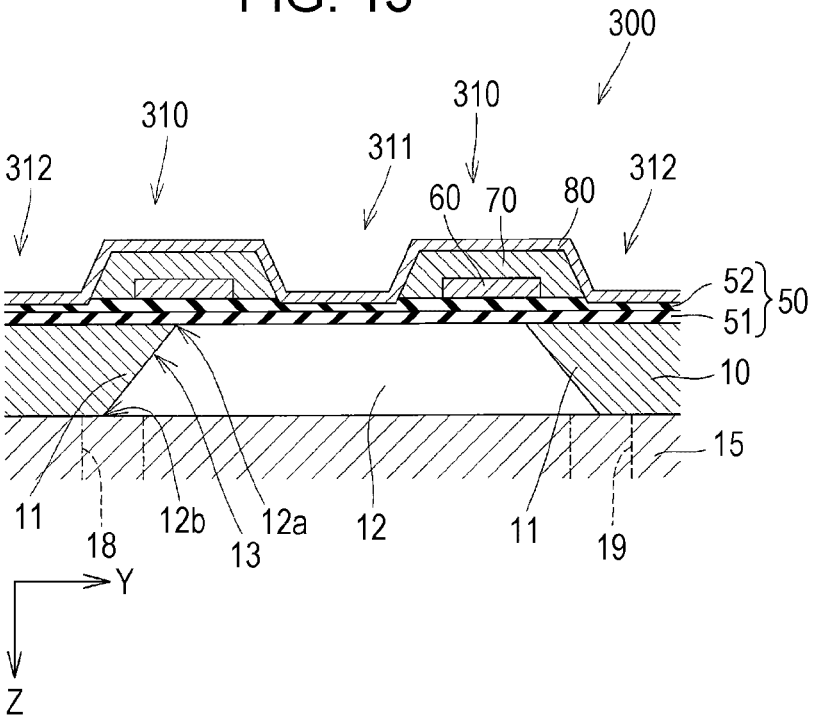
FIG. 13 is an enlarged sectional diagram of the main portions of a recording head according to a second embodiment of the invention.

FIG. 13 is a sectional diagram of the main portions of the ink jet recording head which is an example of the liquid ejecting head according to the second embodiment of the invention. Members which are the same as those in the embodiment described above are assigned identical reference signs and numerals and a repeated description will be omitted.

As illustrated in FIG. 13, in the present embodiment, the diaphragm 50 of the non-drive portions 311 and 312 are thinner in the third direction Z than the other regions, that is, than the diaphragm 50 of the active portion 310. In the present embodiment, in the non-drive portion 311, the thickness of the diaphragm 50 which serves as the bottom surface of the recessed portion 71 of the piezoelectric layer 70 is thinner than the other regions.

For example, it is possible to form the diaphragm 50 by over etching when performing the patterning of the piezoelectric layer 70 using dry etching.

In this manner, by rendering the diaphragm 50 of the non-drive portion 311 thinner than the other regions, it is possible to suppress the hindrance of the deformation of the active portion 310 by the diaphragm 50 of the non-drive portion 311 and for displacement to occur more easily when driving the piezoelectric actuator 300.

Third Embodiment

Figure 14:
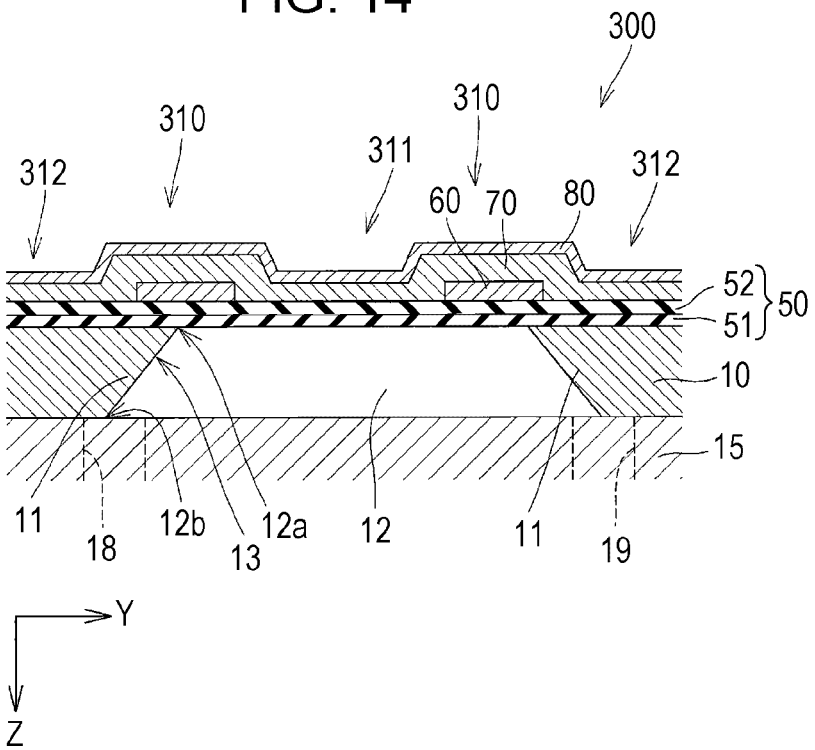
FIG. 14 is an enlarged sectional diagram of the main portions of a recording head according to a third embodiment of the invention.

FIG. 14 is a sectional diagram of the main portions of the ink jet recording head which is an example of the liquid ejecting head according to the third embodiment of the invention. Members which are the same as those in the embodiment described above are assigned identical reference signs and numerals and a repeated description will be omitted.

As illustrated in FIG. 14, in the present embodiment, the piezoelectric layer 70 is formed at the non-drive portion 311. In other words, the recessed portion 71 of the first and second embodiments which are described above is formed in the piezoelectric layer 70. In this manner, by forming the piezoelectric layer 70 at the non-drive portion 311, the rigidity of the non-drive portion 311 is increased, and it is possible to suppress the destruction of the non-drive portion 311.

In the present embodiment, the piezoelectric layer 70 of the non-drive portion 311 is thinner than the active portion 310. Even in the non-drive portion 312, the piezoelectric layer 70 is formed thinly in the same manner as the non-drive portion 311. It is possible to form the thin piezoelectric layer 70 of this thickness using half etching. Naturally, the piezoelectric layer 70 of the non-drive portions 311 and 312 may be formed at the same thickness as the active portion 310.

Fourth Embodiment

Figure 15:
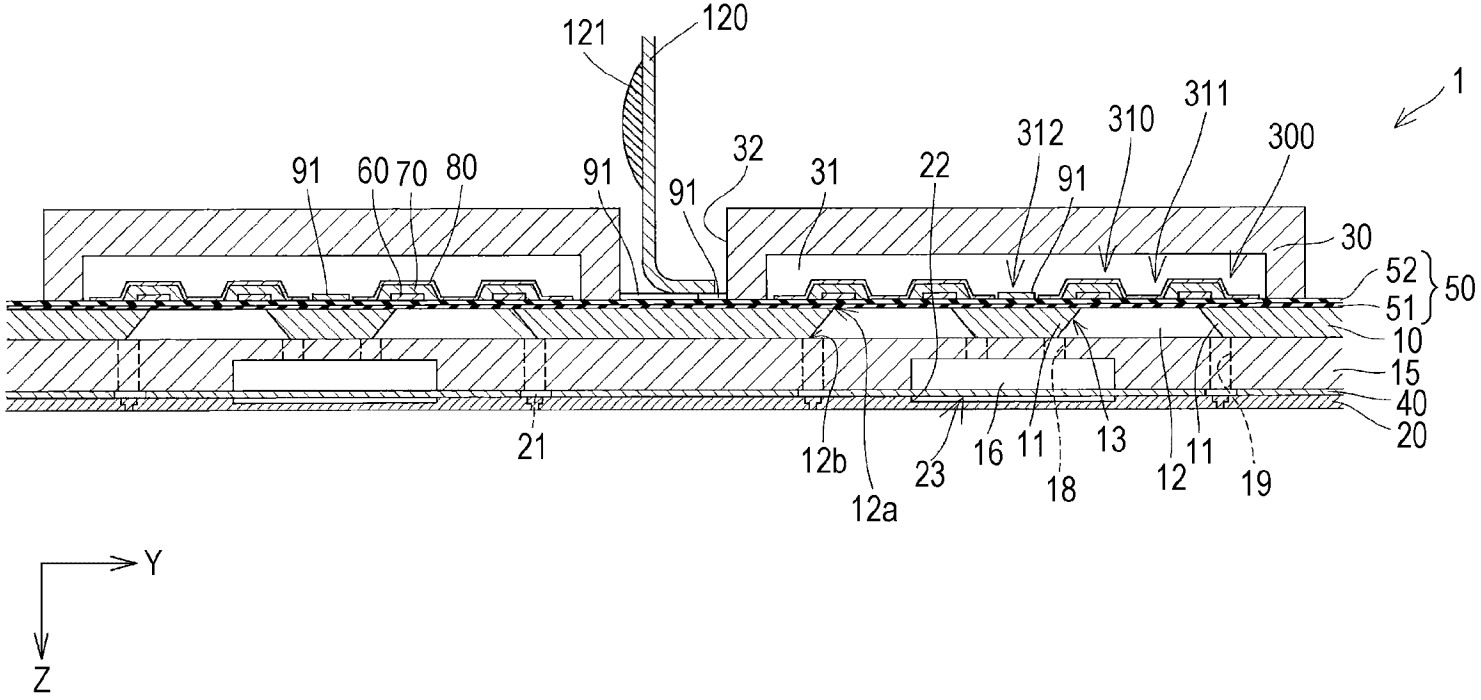
FIG. 15 is a sectional diagram of a recording head according to a fourth embodiment of the invention.

FIG. 15 is a sectional diagram of the main portions of the ink jet recording head which is an example of the liquid ejecting head according to the fourth embodiment of the invention. Members which are the same as those in the embodiment described above are assigned identical reference signs and numerals and a repeated description will be omitted.

As illustrated in FIG. 15, in the present embodiment, a compliance substrate 40 is provided between the communicating plate 15 and the nozzle plate 20. The compliance substrate 40 is a flexible material with low rigidity, for example, it is possible to use a polyphenylene sulfide (PPS) film or the like. Naturally, the compliance substrate 40 may be a metal, a resin, or the like, and the material is not particularly limited.

In the nozzle plate 20, when viewed in plan view from the third direction Z, the recessed portion 22 which is open to the compliance substrate 40 side is provided at a position which overlaps the manifold 16. The portion at which the recessed portion 22 is formed in the compliance substrate 40 serves as the compliance portion 23 which is capable of flexing and deforming. In the present embodiment, the recessed portion 22 is provided in the nozzle plate 20; however, the configuration is not particularly limited thereto, and a through hole which penetrates the nozzle plate 20 in the thickness direction may be provided at a position which overlaps the manifold 16. However, since the compliance substrate 40 is exposed to the liquid ejecting surface in which the nozzles 21 are opened, it is preferable that the through hole of the nozzle plate 20 be covered by another member.

In this manner, even if the compliance portion 23 is formed by providing the compliance substrate 40, it is possible to absorb the pressure fluctuations in the manifolds 16 using the compliance portion 23. Other Embodiments Each of the embodiments of the invention is described above; however, the basic configuration of the invention is not limited to the above-described configuration.

For example, in the embodiments which are described above, the active portion 310 which continues across the sides of the opening 12*a* of the parallelogram of the pressure generating chamber 12 is provided; however, the configuration is not particularly limited thereto, and the active portion 310 may be provided on at least the sides of the opening 12*a* of the parallelogram, and the active portion 310 may be noncontinuous along the sides. For example, when viewed in plan view from the third direction Z, the portions which overlap the corner portions of the opening 12*a* of the parallelogram may be set to non-drive portions and the active portion 310 may be provided to overlap sides other than at the corner portions.

In the embodiments which are described above, the first electrode 60 is set to the individual electrode by providing the first electrodes 60 independently for each of the plurality of active portions 310 and the second electrode 80 is set to the common electrode by providing the second electrode 80 continuously along the plurality of active portions 310; however, the configuration is not particularly limited thereto, and the first electrode 60 may be set to the common electrode by providing the first electrode 60 continuously along the plurality of active portions 310 and the second electrode 80 may be set to the individual electrode by providing the second electrodes 80 independently for each of the plurality of active portions 310. Even if one of the first electrode 60 and the second electrode 80 is the individual electrode and the other is the common electrode, the active portion 310 may be defined by either of the first electrode 60 and the second electrode 80. In other words, even if, as in the embodiments which are described above, the first electrode 60 is the individual electrode, the active portion 310 may be defined by the second electrode 80, and the active portion 310 may be defined by both of the first electrode 60 and the second electrode 80. Even if the second electrode 80 is the individual electrode, the active portion 310 may be defined by the first electrode 60, and the active portion 310 may be defined by both of the first electrode 60 and the second electrode 80.

In the embodiments which are described above, in the second direction Y four rows of the pressure generating chambers 12 are provided to line up in the first direction X; however, a group of two rows of the pressure generating chambers 12 which communicate with the single common manifold may be disposed at different positions in the first direction X. Accordingly, it is possible to dispose the nozzles 21 at twice the density in the first direction X. Therefore, high-density printing becomes possible. The number of rows of the pressure generating chambers 12 is not limited to that which is described above, and there may be one row or multiple rows of greater than or equal to two rows of the pressure generating chambers 12.

Figure 16:
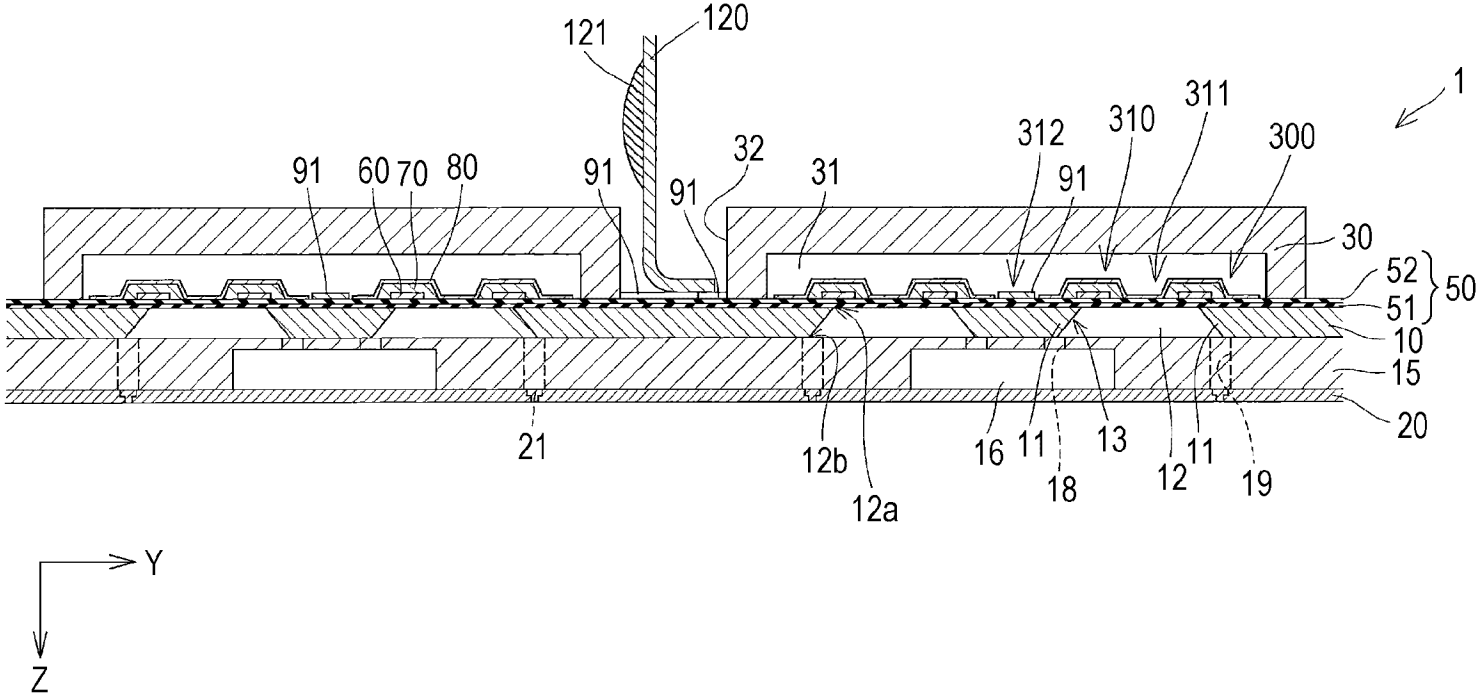
FIG. 16 is a sectional diagram of a recording head according to another embodiment.

In the embodiments which are described above, the compliance portion 23 is provided; however, the configuration is not particularly limited thereto. For example, in a case in which the volume of the manifold 16 is sufficiently secured with respect to the volume of the pressure generating chamber 12 and it is possible to absorb the pressure fluctuations inside the manifold 16 using the ink inside the manifold 16, as illustrated in FIG. 16, the compliance portion 23 may not be provided. FIG. 16 is a sectional diagram of the ink jet recording head according to the other embodiment of the invention.

In the embodiments which are described above, a silicon monocrystalline substrate having a surface with a crystalline plane azimuth of (100) is used as the flow path forming substrate 10; however, the configuration is not limited thereto, and a silicon monocrystalline substrate having a surface with a crystalline plane azimuth of (110) may be used, and a material such as an SOI substrate or glass may be used. The shape of the pressure generating chamber 12 is not limited to that which is described above and may be a shape in which the inclined surface 13 is not provided. The shapes of the openings 12*a* and 12*b* of the pressure generating chamber 12 are not limited to the parallelogram and may be shapes such as a polygon, a circle, and an ellipse.

In the ink jet recording apparatus I which is described above, a configuration is exemplified in which the recording head 1 is mounted on the carriage 3 and moves in the second direction Y; however, the configuration is not particularly limited thereto, and, for example, it is also possible to apply the invention to a so-called line recording apparatus in which the recording head 1 is fixed to the apparatus main body 4 and the printing is performed by only causing the recording sheet S such as the paper to move in the first direction X.

In the embodiments which are described above, the ink jet recording head is given as an example of the liquid ejecting head, and an ink jet recording apparatus is given as an example of the liquid ejecting apparatus; however, the invention is widely targeted at liquid ejecting heads and liquid ejecting apparatuses in general, and naturally, it is possible to apply the invention to a liquid ejecting head or a liquid ejecting apparatus which ejects a liquid other than the ink. Examples of other liquid ejecting heads include a variety of recording heads which are used in an image recording apparatus such as a printer, color material ejecting heads which are used in the manufacture of color filters of liquid crystal displays and the like, electrode material ejecting heads which are used to form electrodes of organic EL displays, field emission displays (FED), and the like, and biological organic matter ejecting heads which are used in the manufacture of biochips. It is possible to apply the other liquid ejecting heads to a liquid ejecting apparatus which is provided with the liquid ejecting head.

The invention is not limited to the liquid ejecting head and may also be used in another piezoelectric device having a substrate provided with a space and a piezoelectric actuator. Examples of other piezoelectric devices include, an ultrasonic device such as an ultrasonic transmitter, an ultrasonic motor, a thermoelectric converter, a pressure-electric converter, a ferroelectric transistor, a piezoelectric transformer, a filter such as a blocking filter of harmful light such as infrared rays, an optical filter using the photonic crystal effect by quantum dot formation, and an optical filter using thin film optical interference, various sensors such as an infrared sensor, an ultrasonic sensor, a thermal sensor, a pressure sensor, a pyroelectric sensor, and a gyroscope (an angular velocity sensor), and ferroelectric memory.

What is claimed is:

1. A liquid ejecting head comprising:

a flow path forming substrate, in which a pressure generating chamber which communicates with a nozzle which ejects a liquid, is formed by a partitioning wall; and a piezoelectric actuator in which a first electrode, a piezoelectric layer, and a second electrode are laminated; and the pressure generating chamber including a first opening which is disposed on the piezoelectric actuator side, and a second opening which is disposed on the opposite side of the piezoelectric actuator side; and the piezoelectric layer includes an active portion which is interposed between the first electrode and the second electrode in a lamination direction, and wherein when viewed in plan view from the lamination direction, the active portion overlaps at least a portion of the edges of each side of the first opening, and wherein when viewed in plan view from the lamination direction, the first electrode is not disposed in at least a portion of the first opening, wherein when viewed in plan view from the lamination direction, the first opening and the second opening form a parallelogram which has acute angle corners; and wherein the second opening is larger than the first opening.

2. The liquid ejecting head according to claim 1, wherein the second opening includes a first acute angle corner, and wherein the pressure generating chamber communicates with the nozzle at the first acute angle corner.

3. The liquid ejecting head according to claim 2, wherein the liquid ejecting head includes a supply path which supplies a liquid to the pressure generating chamber, wherein the second opening includes a second acute angle corner on the opposite side from the first acute angle corner, and wherein the pressure generating chamber communicates with the nozzle at the second acute angle corner.

4. A liquid ejecting head comprising:

a flow path forming substrate, in which a pressure generating chamber which communicates with a nozzle which ejects a liquid, is formed by a partitioning wall; and a piezoelectric actuator in which a first electrode, a piezoelectric layer, and a second electrode are laminated; and the pressure generating chamber including a first opening which is disposed on the piezoelectric actuator side, and a second opening which is disposed on the opposite side of the piezoelectric actuator side; and the piezoelectric layer includes an active portion which is interposed between the first electrode and the second electrode in a lamination direction, and wherein when viewed in plan view from the lamination direction, the active portion overlaps at least a portion of the edges of each side of the first opening, and wherein when viewed in plan view from the lamination direction, the first electrode is not disposed in at least a portion of the first opening, wherein when viewed in plan view from the lamination direction, the first opening and the second opening form a parallelogram which has acute angle corners, and wherein when viewed in plan view from the lamination direction, the first opening and the second opening are disposed such that the acute angle corners of the first opening and the acute angle corners of the second opening are reversed.

5. A liquid ejecting head comprising:

a flow path forming substrate, in which a pressure generating chamber which communicates with a nozzle which ejects a liquid, is formed by a partitioning wall; and a piezoelectric actuator in which a first electrode, a piezoelectric layer, and a second electrode are laminated; and the pressure generating chamber including a first opening which is disposed on the piezoelectric actuator side, and a second opening which is disposed on the opposite side of the piezoelectric actuator side; and the piezoelectric layer includes an active portion which is interposed between the first electrode and the second electrode in a lamination direction, and wherein when viewed in plan view from the lamination direction, the active portion overlaps at least a portion of the edges of each side of the first opening, and wherein when viewed in plan view from the lamination direction, the first electrode is not disposed in at least a portion of the first opening, wherein when viewed in plan view from the lamination direction, the first opening and the second opening form a parallelogram which has acute angle corners, wherein the first electrode, the piezoelectric layer, and the second electrode are laminated in this order from the pressure generating chamber side on the edges of the first opening, and wherein the edges of the first opening include a first edge and a second edge which are parallel to each other, and wherein when viewed in plan view from the lamination direction, the second electrode extends from the first edge to the second edge.

6. The liquid ejecting head according to claim 1, wherein the liquid ejecting head includes a plurality of the nozzles forming a nozzle row along a first direction which is perpendicular to the lamination direction, wherein when viewed in plan view from the lamination direction, two edges of the first opening are parallel with a second direction which is perpendicular to the first direction and the lamination direction.

7. The liquid ejecting head according to claim 6, wherein when viewed in plan view from the lamination direction, two edges of the second opening are parallel with the second direction.

* * * * *